US009184518B2

(12) United States Patent
Ivey et al.

(10) Patent No.: US 9,184,518 B2
(45) Date of Patent: Nov. 10, 2015

(54) ELECTRICAL CONNECTOR HEADER FOR AN LED-BASED LIGHT

(71) Applicant: iLumisys, Inc., Troy, MI (US)

(72) Inventors: John Ivey, Farmington Hills, MI (US); Ryan Meganck, Troy, MI (US); Hoan Ngo, Sterling Heights, MI (US); James Amrine, Ann Arbor, MI (US)

(73) Assignee: ILUMISYS, INC., Troy, MI (US)

( * ) Notice: Subject to any disclaimer, the term of this patent is extended or adjusted under 35 U.S.C. 154(b) by 341 days.

(21) Appl. No.: 13/782,763

(22) Filed: Mar. 1, 2013

(65) Prior Publication Data

US 2013/0230995 A1 Sep. 5, 2013

Related U.S. Application Data

(60) Provisional application No. 61/605,987, filed on Mar. 2, 2012.

(51) Int. Cl.
*H01R 12/71* (2011.01)
*H01R 43/20* (2006.01)
(Continued)

(52) U.S. Cl.
CPC ..... *H01R 12/71* (2013.01); *F21K 9/175* (2013.10); *F21K 9/90* (2013.01); *F21V 23/006* (2013.01);
(Continued)

(58) Field of Classification Search
CPC ..... F21S 8/06; F21S 8/026; F21S 8/04; F21S 8/02; F21S 2/005; H01R 12/71
USPC ..... 362/249.02, 404
See application file for complete search history.

(56) References Cited

U.S. PATENT DOCUMENTS

D79,814 S 11/1929 Hoch
D80,419 S 1/1930 Kramer
(Continued)

FOREIGN PATENT DOCUMENTS

CN 1584388 A 2/2005
CN 2766345 Y 3/2006
(Continued)

OTHER PUBLICATIONS

Best Practice Guide—Commercial Office Buildings—Central HVAC System. [online], [Retrieved on Jan. 17, 2008] Retrieved from FlexYour Power Organization web page using Internet <URL: http://www.fypower.org/bpg/module.html?b=offices&m+Central HVAC Systems&s=Contr . . . >.
(Continued)

*Primary Examiner* — Sean Gramling
*Assistant Examiner* — Gerald J Sufleta, II
(74) *Attorney, Agent, or Firm* — Young, Basile, Hanlon & MacFarlane, P.C.

(57) ABSTRACT

An LED-based light configured for replacing a conventional fluorescent light in a fluorescent light fixture comprises: an LED circuit board including at least one LED; a power supply circuit board configured to supply power to the at least one LED; an end cap carrying at least one pin configured for connection to the fixture; a pin connector header including a first body retentively supporting at least one pin connecting lead and configured to engage the power supply circuit board such that the pin connecting lead is positioned to electrically connect the power supply circuit board and the pin; and a circuit connector header including a second body retentively supporting at least one circuit connecting lead and configured to engage the power supply circuit board such that the circuit connecting lead is positioned to electrically connect the power supply circuit board and the LED circuit board.

14 Claims, 6 Drawing Sheets

(51) Int. Cl.

| | |
|---|---|
| ***F21K 99/00*** | (2010.01) |
| ***F21V 23/00*** | (2015.01) |
| ***F21V 23/06*** | (2006.01) |
| *F21Y 101/02* | (2006.01) |
| *F21Y 103/00* | (2006.01) |

(52) U.S. Cl.

CPC ..... *F21V 23/06* (2013.01); *H01R 43/20* (2013.01); *F21Y 2101/02* (2013.01); *F21Y 2103/003* (2013.01); *Y10T 29/49204* (2015.01)

(56) References Cited

U.S. PATENT DOCUMENTS

| | | | |
|---|---|---|---|
| D84,763 | S | 7/1931 | Strange |
| D119,797 | S | 4/1940 | Winkler et al. |
| D125,312 | S | 2/1941 | Logan |
| 2,826,679 | A | 3/1958 | Rosenburg |
| 2,909,097 | A | 10/1959 | Alden et al. |
| 3,272,977 | A | 9/1966 | Holmes |
| 3,318,185 | A | 5/1967 | Kott |
| 3,561,719 | A | 2/1971 | Grindle |
| 3,586,936 | A | 6/1971 | Mcleroy |
| 3,601,621 | A | 8/1971 | Ritchie |
| 3,612,855 | A | 10/1971 | Juhnke |
| 3,643,088 | A | 2/1972 | Osteen et al. |
| 3,739,336 | A | 6/1973 | Burland |
| 3,746,918 | A | 7/1973 | Drucker et al. |
| 3,818,216 | A | 6/1974 | Larraburu |
| 3,832,503 | A | 8/1974 | Crane |
| 3,858,086 | A | 12/1974 | Anderson et al. |
| 3,909,670 | A | 9/1975 | Wakamatsu et al. |
| 3,924,120 | A | 12/1975 | Cox, III |
| 3,958,885 | A | 5/1976 | Stockinger et al. |
| 3,969,720 | A | 7/1976 | Nishino |
| 3,974,637 | A | 8/1976 | Bergey et al. |
| 3,993,386 | A | 11/1976 | Rowe |
| 4,001,571 | A | 1/1977 | Martin |
| 4,054,814 | A | 10/1977 | Fegley et al. |
| 4,070,568 | A | 1/1978 | Gala |
| 4,082,395 | A | 4/1978 | Donato et al. |
| 4,096,349 | A | 6/1978 | Donato |
| 4,102,558 | A | 7/1978 | Krachman |
| 4,107,581 | A | 8/1978 | Abernethy |
| 4,189,663 | A | 2/1980 | Schmutzer et al. |
| 4,211,955 | A | 7/1980 | Ray |
| 4,241,295 | A | 12/1980 | Williams, Jr. |
| 4,261,029 | A | 4/1981 | Mousset |
| 4,262,255 | A | 4/1981 | Kokei et al. |
| 4,271,408 | A | 6/1981 | Teshima et al. |
| 4,271,458 | A | 6/1981 | George, Jr. |
| 4,272,689 | A | 6/1981 | Crosby et al. |
| 4,273,999 | A | 6/1981 | Pierpoint |
| 4,298,869 | A | 11/1981 | Okuno |
| 4,329,625 | A | 5/1982 | Nishizawa et al. |
| 4,339,788 | A | 7/1982 | White et al. |
| 4,342,947 | A | 8/1982 | Bloyd |
| 4,344,117 | A | 8/1982 | Niccum |
| 4,367,464 | A | 1/1983 | Kurahashi et al. |
| D268,134 | S | 3/1983 | Zurcher |
| 4,382,272 | A | 5/1983 | Quella et al. |
| 4,388,567 | A | 6/1983 | Yamazaki et al. |
| 4,388,589 | A | 6/1983 | Molldrem, Jr. |
| 4,392,187 | A | 7/1983 | Bornhorst |
| 4,394,719 | A | 7/1983 | Moberg |
| 4,420,711 | A | 12/1983 | Takahashi et al. |
| 4,455,562 | A | 6/1984 | Dolan et al. |
| 4,500,796 | A | 2/1985 | Quin |
| 4,521,835 | A | 6/1985 | Meggs et al. |
| 4,531,114 | A | 7/1985 | Topol et al. |
| 4,581,687 | A | 4/1986 | Nakanishi |
| 4,597,033 | A | 6/1986 | Meggs et al. |
| 4,600,972 | A | 7/1986 | MacIntyre |
| 4,607,317 | A | 8/1986 | Lin |
| 4,622,881 | A | 11/1986 | Rand |
| 4,625,152 | A | 11/1986 | Nakai |
| 4,635,052 | A | 1/1987 | Aoike et al. |
| 4,647,217 | A | 3/1987 | Havel |
| 4,656,398 | A | 4/1987 | Michael et al. |
| 4,661,890 | A | 4/1987 | Watanabe et al. |
| 4,668,895 | A | 5/1987 | Schneiter |
| 4,669,033 | A | 5/1987 | Lee |
| 4,675,575 | A | 6/1987 | Smith et al. |
| 4,682,079 | A | 7/1987 | Sanders et al. |
| 4,686,425 | A | 8/1987 | Havel |
| 4,687,340 | A | 8/1987 | Havel |
| 4,688,154 | A | 8/1987 | Nilssen |
| 4,688,869 | A | 8/1987 | Kelly |
| 4,695,769 | A | 9/1987 | Schweickardt |
| 4,698,730 | A | 10/1987 | Sakai et al. |
| 4,701,669 | A | 10/1987 | Head et al. |
| 4,705,406 | A | 11/1987 | Havel |
| 4,707,141 | A | 11/1987 | Havel |
| D293,723 | S | 1/1988 | Buttner |
| 4,727,289 | A | 2/1988 | Uchida |
| 4,739,454 | A | 4/1988 | Federgreen |
| 4,740,882 | A | 4/1988 | Miller |
| 4,748,545 | A | 5/1988 | Schmitt |
| 4,753,148 | A | 6/1988 | Johnson |
| 4,758,173 | A | 7/1988 | Northrop |
| 4,765,708 | A | 8/1988 | Becker et al. |
| 4,771,274 | A | 9/1988 | Havel |
| 4,780,621 | A | 10/1988 | Bartleucci et al. |
| 4,794,373 | A | 12/1988 | Harrison |
| 4,794,383 | A | 12/1988 | Havel |
| 4,801,928 | A | 1/1989 | Minter |
| 4,810,937 | A | 3/1989 | Havel |
| 4,818,072 | A | 4/1989 | Mohebban |
| 4,824,269 | A | 4/1989 | Havel |
| 4,837,565 | A | 6/1989 | White |
| 4,843,627 | A | 6/1989 | Stebbins |
| 4,845,481 | A | 7/1989 | Havel |
| 4,845,745 | A | 7/1989 | Havel |
| 4,851,972 | A | 7/1989 | Altman |
| 4,854,701 | A | 8/1989 | Noll et al. |
| 4,857,801 | A | 8/1989 | Farrell |
| 4,863,223 | A | 9/1989 | Weissenbach et al. |
| 4,870,325 | A | 9/1989 | Kazar |
| 4,874,320 | A | 10/1989 | Freed et al. |
| 4,887,074 | A | 12/1989 | Simon et al. |
| 4,894,832 | A | 1/1990 | Colak |
| 4,901,207 | A | 2/1990 | Sato et al. |
| 4,904,988 | A | 2/1990 | Nesbit et al. |
| 4,912,371 | A | 3/1990 | Hamilton |
| 4,922,154 | A | 5/1990 | Cacoub |
| 4,929,936 | A | 5/1990 | Friedman et al. |
| 4,934,852 | A | 6/1990 | Havel |
| 4,941,072 | A | 7/1990 | Yasumoto et al. |
| 4,943,900 | A | 7/1990 | Gartner |
| 4,962,687 | A | 10/1990 | Belliveau et al. |
| 4,965,561 | A | 10/1990 | Havel |
| 4,973,835 | A | 11/1990 | Kurosu et al. |
| 4,977,351 | A | 12/1990 | Bavaro et al. |
| 4,979,081 | A | 12/1990 | Leach et al. |
| 4,979,180 | A | 12/1990 | Muncheryan |
| 4,980,806 | A | 12/1990 | Taylor et al. |
| 4,991,070 | A | 2/1991 | Stob |
| 4,992,704 | A | 2/1991 | Stinson |
| 5,003,227 | A | 3/1991 | Nilssen |
| 5,008,595 | A | 4/1991 | Kazar |
| 5,008,788 | A | 4/1991 | Palinkas |
| 5,010,459 | A | 4/1991 | Taylor et al. |
| 5,018,054 | A | 5/1991 | Ohashi et al. |
| 5,027,037 | A | 6/1991 | Wei |
| 5,027,262 | A | 6/1991 | Freed |
| 5,032,960 | A | 7/1991 | Katoh |
| 5,034,807 | A | 7/1991 | Von Kohorn |
| 5,036,248 | A | 7/1991 | McEwan et al. |
| 5,038,255 | A | 8/1991 | Nishihashi et al. |
| 5,065,226 | A | 11/1991 | Kluitmans et al. |
| 5,072,216 | A | 12/1991 | Grange |
| 5,078,039 | A | 1/1992 | Tulk et al. |
| 5,083,063 | A | 1/1992 | Brooks |
| 5,088,013 | A | 2/1992 | Revis |
| 5,089,748 | A | 2/1992 | Ihms |

(56) References Cited

U.S. PATENT DOCUMENTS

| | | | |
|---|---|---|---|
| 5,103,382 | A | 4/1992 | Kondo et al. |
| 5,122,733 | A | 6/1992 | Havel |
| 5,126,634 | A | 6/1992 | Johnson |
| 5,128,595 | A | 7/1992 | Hara |
| 5,130,909 | A | 7/1992 | Gross |
| 5,134,387 | A | 7/1992 | Smith et al. |
| 5,136,483 | A | 8/1992 | Schoniger et al. |
| 5,140,220 | A | 8/1992 | Hasegawa |
| 5,142,199 | A | 8/1992 | Elwell |
| 5,151,679 | A | 9/1992 | Dimmick |
| 5,154,641 | A | 10/1992 | McLaughlin |
| 5,161,879 | A | 11/1992 | McDermott |
| 5,161,882 | A | 11/1992 | Garrett |
| 5,164,715 | A | 11/1992 | Kashiwabara et al. |
| 5,184,114 | A | 2/1993 | Brown |
| 5,194,854 | A | 3/1993 | Havel |
| 5,198,756 | A | 3/1993 | Jenkins et al. |
| 5,209,560 | A | 5/1993 | Taylor et al. |
| 5,220,250 | A | 6/1993 | Szuba |
| 5,225,765 | A | 7/1993 | Callahan et al. |
| 5,226,723 | A | 7/1993 | Chen |
| 5,254,910 | A | 10/1993 | Yang |
| 5,256,948 | A | 10/1993 | Boldin et al. |
| 5,278,542 | A | 1/1994 | Smith et al. |
| 5,282,121 | A | 1/1994 | Bornhorst et al. |
| 5,283,517 | A | 2/1994 | Havel |
| 5,287,352 | A | 2/1994 | Jackson et al. |
| 5,294,865 | A | 3/1994 | Haraden |
| 5,298,871 | A | 3/1994 | Shimohara |
| 5,301,090 | A | 4/1994 | Hed |
| 5,303,124 | A | 4/1994 | Wrobel |
| 5,307,295 | A | 4/1994 | Taylor et al. |
| 5,321,593 | A | 6/1994 | Moates |
| 5,323,226 | A | 6/1994 | Schreder |
| 5,329,431 | A | 7/1994 | Taylor et al. |
| 5,344,068 | A | 9/1994 | Haessig |
| 5,350,977 | A | 9/1994 | Hamamoto et al. |
| 5,357,170 | A | 10/1994 | Luchaco et al. |
| 5,365,411 | A | 11/1994 | Rycroft et al. |
| 5,371,618 | A | 12/1994 | Tai et al. |
| 5,374,876 | A | 12/1994 | Horibata et al. |
| 5,375,043 | A | 12/1994 | Tokunaga |
| D354,360 | S | 1/1995 | Murata |
| 5,381,074 | A | 1/1995 | Rudzewicz et al. |
| 5,388,357 | A | 2/1995 | Malita |
| 5,402,702 | A | 4/1995 | Hata |
| 5,404,094 | A | 4/1995 | Green et al. |
| 5,404,282 | A | 4/1995 | Klinke et al. |
| 5,406,176 | A | 4/1995 | Sugden |
| 5,410,328 | A | 4/1995 | Yoksza et al. |
| 5,412,284 | A | 5/1995 | Moore et al. |
| 5,412,552 | A | 5/1995 | Fernandes |
| 5,420,482 | A | 5/1995 | Phares |
| 5,421,059 | A | 6/1995 | Leffers, Jr. |
| 5,430,356 | A | 7/1995 | Ference et al. |
| 5,432,408 | A | 7/1995 | Matsuda et al. |
| 5,436,535 | A | 7/1995 | Yang |
| 5,436,853 | A | 7/1995 | Shimohara |
| 5,450,301 | A | 9/1995 | Waltz et al. |
| 5,461,188 | A | 10/1995 | Drago et al. |
| 5,463,280 | A | 10/1995 | Johnson |
| 5,463,502 | A | 10/1995 | Savage, Jr. |
| 5,465,144 | A | 11/1995 | Parker et al. |
| 5,473,522 | A | 12/1995 | Kriz et al. |
| 5,475,300 | A | 12/1995 | Havel |
| 5,481,441 | A | 1/1996 | Stevens |
| 5,489,827 | A | 2/1996 | Xia |
| 5,491,402 | A | 2/1996 | Small |
| 5,493,183 | A | 2/1996 | Kimball |
| 5,504,395 | A | 4/1996 | Johnson et al. |
| 5,506,760 | A | 4/1996 | Giebler et al. |
| 5,513,082 | A | 4/1996 | Asano |
| 5,519,496 | A | 5/1996 | Borgert et al. |
| 5,530,322 | A | 6/1996 | Ference et al. |
| 5,544,809 | A | 8/1996 | Keating et al. |
| 5,545,950 | A | 8/1996 | Cho |
| 5,550,440 | A | 8/1996 | Allison et al. |
| 5,559,681 | A | 9/1996 | Duarte |
| 5,561,346 | A | 10/1996 | Byrne |
| D376,030 | S | 11/1996 | Cohen |
| 5,575,459 | A | 11/1996 | Anderson |
| 5,575,554 | A | 11/1996 | Guritz |
| 5,581,158 | A | 12/1996 | Quazi |
| 5,592,051 | A | 1/1997 | Korkala |
| 5,592,054 | A | 1/1997 | Nerone et al. |
| 5,600,199 | A | 2/1997 | Martin, Sr. et al. |
| 5,607,227 | A | 3/1997 | Yasumoto et al. |
| 5,608,290 | A | 3/1997 | Hutchisson et al. |
| 5,614,788 | A | 3/1997 | Mullins et al. |
| 5,621,282 | A | 4/1997 | Haskell |
| 5,621,603 | A | 4/1997 | Adamec et al. |
| 5,621,662 | A | 4/1997 | Humphries et al. |
| 5,622,423 | A | 4/1997 | Lee |
| 5,633,629 | A | 5/1997 | Hochstein |
| 5,634,711 | A | 6/1997 | Kennedy et al. |
| 5,640,061 | A | 6/1997 | Bornhorst et al. |
| 5,640,141 | A | 6/1997 | Myllymaki |
| 5,642,129 | A | 6/1997 | Zavracky et al. |
| 5,655,830 | A | 8/1997 | Ruskouski |
| 5,656,935 | A | 8/1997 | Havel |
| 5,661,374 | A | 8/1997 | Cassidy et al. |
| 5,661,645 | A | 8/1997 | Hochstein |
| 5,673,059 | A | 9/1997 | Zavracky et al. |
| 5,682,103 | A | 10/1997 | Burrell |
| 5,684,523 | A | 11/1997 | Satoh et al. |
| 5,688,042 | A | 11/1997 | Madadi et al. |
| 5,697,695 | A | 12/1997 | Lin et al. |
| 5,701,058 | A | 12/1997 | Roth |
| 5,712,650 | A | 1/1998 | Barlow |
| 5,713,655 | A | 2/1998 | Blackman |
| 5,721,471 | A | 2/1998 | Begemann et al. |
| 5,725,148 | A | 3/1998 | Hartman |
| 5,726,535 | A | 3/1998 | Yan |
| 5,731,759 | A | 3/1998 | Finucan |
| 5,734,590 | A | 3/1998 | Tebbe |
| 5,751,118 | A | 5/1998 | Mortimer |
| 5,752,766 | A | 5/1998 | Bailey et al. |
| 5,765,940 | A | 6/1998 | Levy et al. |
| 5,769,527 | A | 6/1998 | Taylor et al. |
| 5,784,006 | A | 7/1998 | Hochstein |
| 5,785,227 | A | 7/1998 | Akiba |
| 5,790,329 | A | 8/1998 | Klaus et al. |
| 5,803,579 | A | 9/1998 | Turnbull et al. |
| 5,803,580 | A | 9/1998 | Tseng |
| 5,803,729 | A | 9/1998 | Tsimerman |
| 5,806,965 | A | 9/1998 | Deese |
| 5,808,689 | A | 9/1998 | Small |
| 5,810,463 | A | 9/1998 | Kawahara et al. |
| 5,812,105 | A | 9/1998 | Van de Ven |
| 5,813,751 | A | 9/1998 | Shaffer |
| 5,813,753 | A | 9/1998 | Vriens et al. |
| 5,821,695 | A | 10/1998 | Vilanilam et al. |
| 5,825,051 | A | 10/1998 | Bauer et al. |
| 5,828,178 | A | 10/1998 | York et al. |
| 5,831,522 | A | 11/1998 | Weed et al. |
| 5,836,676 | A | 11/1998 | Ando et al. |
| 5,848,837 | A | 12/1998 | Gustafson |
| 5,850,126 | A | 12/1998 | Kanbar |
| 5,851,063 | A | 12/1998 | Doughty et al. |
| 5,852,658 | A | 12/1998 | Knight et al. |
| 5,854,542 | A | 12/1998 | Forbes |
| RE36,030 | E | 1/1999 | Nadeau |
| 5,859,508 | A | 1/1999 | Ge et al. |
| 5,865,529 | A | 2/1999 | Yan |
| 5,890,794 | A | 4/1999 | Abtahi et al. |
| 5,896,010 | A | 4/1999 | Mikolajczak et al. |
| 5,904,415 | A | 5/1999 | Robertson et al. |
| 5,907,742 | A | 5/1999 | Johnson et al. |
| 5,909,378 | A | 6/1999 | De Milleville |
| 5,912,653 | A | 6/1999 | Fitch |
| 5,917,287 | A | 6/1999 | Haederle et al. |
| 5,917,534 | A | 6/1999 | Rajeswaran |
| 5,921,660 | A | 7/1999 | Yu |
| 5,924,784 | A | 7/1999 | Chliwnyj et al. |

(56) References Cited

U.S. PATENT DOCUMENTS 5,927,845 A 7/1999 Gustafson et al.
5,934,792 A 8/1999 Camarota
5,936,599 A 8/1999 Reymond
5,943,802 A 8/1999 Tijanic
5,946,209 A 8/1999 Eckel et al.
5,949,347 A 9/1999 Wu
5,951,145 A 9/1999 Iwasaki et al.
5,952,680 A 9/1999 Strite
5,959,547 A 9/1999 Tubel et al.
5,961,072 A 10/1999 Bodle
5,962,989 A 10/1999 Baker
5,962,992 A 10/1999 Huang et al.
5,963,185 A 10/1999 Havel
5,966,069 A 10/1999 Zmurk et al.
5,974,553 A 10/1999 Gandar
5,980,064 A 11/1999 Metroyanis
5,998,925 A 12/1999 Shimizu et al.
5,998,928 A 12/1999 Hipp
6,000,807 A 12/1999 Moreland
6,007,209 A 12/1999 Pelka
6,008,783 A 12/1999 Kitagawa et al.
6,010,228 A 1/2000 Blackman et al.
6,011,691 A 1/2000 Schreffler
6,016,038 A 1/2000 Mueller et al.
6,018,237 A 1/2000 Havel
6,019,493 A 2/2000 Kuo et al.
6,020,825 A 2/2000 Chansky et al.
6,025,550 A 2/2000 Kato
6,028,694 A 2/2000 Schmidt
6,030,099 A 2/2000 McDermott
6,031,343 A 2/2000 Recknagel et al.
D422,737 S 4/2000 Orozco
6,056,420 A 5/2000 Wilson et al.
6,068,383 A 5/2000 Robertson et al.
6,069,597 A 5/2000 Hansen
6,072,280 A 6/2000 Allen
6,084,359 A 7/2000 Hetzel et al.
6,086,220 A 7/2000 Lash et al.
6,091,200 A 7/2000 Lenz
6,092,915 A 7/2000 Rensch
6,095,661 A 8/2000 Lebens et al.
6,097,352 A 8/2000 Zavracky et al.
6,116,748 A 9/2000 George
6,121,875 A 9/2000 Hamm et al.
6,127,783 A 10/2000 Pashley et al.
6,132,072 A 10/2000 Turnbull et al.
6,135,604 A 10/2000 Lin
6,135,620 A 10/2000 Marsh
6,139,174 A 10/2000 Butterworth
6,149,283 A 11/2000 Conway et al.
6,150,774 A 11/2000 Mueller et al.
6,151,529 A 11/2000 Batko
6,153,985 A 11/2000 Grossman
6,158,882 A 12/2000 Bischoff, Jr.
6,166,496 A 12/2000 Lys et al.
6,175,201 B1 1/2001 Sid
6,175,220 B1 1/2001 Billig et al.
6,181,126 B1 1/2001 Havel
D437,947 S 2/2001 Huang
6,183,086 B1 2/2001 Neubert
6,183,104 B1 2/2001 Ferrara
6,184,628 B1 2/2001 Ruthenberg
6,196,471 B1 3/2001 Ruthenberg
6,203,180 B1 3/2001 Fleischmann
6,211,626 B1 4/2001 Lys et al.
6,215,409 B1 4/2001 Blach
6,217,190 B1 4/2001 Altman et al.
6,219,239 B1 4/2001 Mellberg et al.
6,227,679 B1 5/2001 Zhang et al.
6,238,075 B1 5/2001 Dealey, Jr. et al.
6,241,359 B1 6/2001 Lin
6,249,221 B1 6/2001 Reed
6,250,774 B1 6/2001 Begemann et al.
6,252,350 B1 6/2001 Alvarez
6,252,358 B1 6/2001 Xydis et al.
6,268,600 B1 7/2001 Nakamura et al.
6,273,338 B1 8/2001 White
6,275,397 B1 8/2001 McClain
6,283,612 B1 9/2001 Hunter
6,292,901 B1 9/2001 Lys et al.
6,293,684 B1 9/2001 Riblett
6,297,724 B1 10/2001 Bryans et al.
6,305,109 B1 10/2001 Lee
6,305,821 B1 10/2001 Hsieh et al.
6,307,331 B1 10/2001 Bonasia et al.
6,310,590 B1 10/2001 Havel
6,315,429 B1 11/2001 Grandolfo
6,323,832 B1 11/2001 Nishizawa et al.
6,325,651 B1 12/2001 Nishihara et al.
6,334,699 B1 1/2002 Gladnick
6,340,868 B1 1/2002 Lys et al.
6,354,714 B1 3/2002 Rhodes
6,361,186 B1 3/2002 Slayden
6,362,578 B1 3/2002 Swanson et al.
6,369,525 B1 4/2002 Chang et al.
6,371,637 B1 4/2002 Atchinson et al.
6,373,733 B1 4/2002 Wu et al.
6,379,022 B1 4/2002 Amerson et al.
D457,667 S 5/2002 Piepgras et al.
D457,669 S 5/2002 Piepgras et al.
D457,974 S 5/2002 Piepgras et al.
6,388,393 B1 5/2002 Illingworth
6,394,623 B1 5/2002 Tsui
6,396,216 B1 5/2002 Noone et al.
D458,395 S 6/2002 Piepgras et al.
6,400,096 B1 6/2002 Wells et al.
6,404,131 B1 6/2002 Kawano et al.
6,411,022 B1 6/2002 Machida
6,411,045 B1 6/2002 Nerone
6,422,716 B2 7/2002 Henrici et al.
6,428,189 B1 8/2002 Hochstein
6,429,604 B1 8/2002 Chang
D463,610 S 9/2002 Piepgras et al.
6,445,139 B1 9/2002 Marshall et al.
6,448,550 B1 9/2002 Nishimura
6,448,716 B1 9/2002 Hutchison
6,459,919 B1 10/2002 Lys et al.
6,464,373 B1 10/2002 Petrick
6,469,457 B2 10/2002 Callahan
6,471,388 B1 10/2002 Marsh
6,472,823 B2 10/2002 Yen
6,473,002 B1 10/2002 Hutchison
D468,035 S 12/2002 Blanc et al.
6,488,392 B1 12/2002 Lu
6,495,964 B1 12/2002 Muthu et al.
6,511,204 B2 1/2003 Emmel et al.
6,517,218 B2 2/2003 Hochstein
6,521,879 B1 2/2003 Rand et al.
6,527,411 B1 3/2003 Sayers
6,528,954 B1 3/2003 Lys et al.
6,528,958 B2 3/2003 Hulshof et al.
6,538,375 B1 3/2003 Duggal et al.
6,540,381 B1 4/2003 Douglass, II
6,541,800 B2 4/2003 Barnett et al.
6,548,967 B1 4/2003 Dowling et al.
6,568,834 B1 5/2003 Scianna
6,573,536 B1 6/2003 Dry
6,577,072 B2 6/2003 Saito et al.
6,577,080 B2 6/2003 Lys et al.
6,577,512 B2 6/2003 Tripathi et al.
6,577,794 B1 6/2003 Currie et al.
6,578,979 B2 6/2003 Truttmann-Battig
6,582,103 B1 6/2003 Popovich et al.
6,583,550 B2 6/2003 Iwasa et al.
6,583,573 B2 6/2003 Bierman
D477,093 S 7/2003 Moriyama et al.
6,585,393 B1 7/2003 Brandes et al.
6,586,890 B2 7/2003 Min et al.
6,590,343 B2 7/2003 Pederson
6,592,238 B2 7/2003 Cleaver et al.
6,596,977 B2 7/2003 Muthu et al.
6,598,996 B1 7/2003 Lodhie
6,608,453 B2 8/2003 Morgan et al.
6,608,614 B1 8/2003 Johnson

(56) References Cited

U.S. PATENT DOCUMENTS 6,609,804 B2 8/2003 Nolan et al.
6,609,813 B1 8/2003 Showers et al.
6,612,712 B2 9/2003 Nepil
6,612,717 B2 9/2003 Yen
6,612,729 B1 9/2003 Hoffman
6,621,222 B1 9/2003 Hong
6,623,151 B2 9/2003 Pederson
6,624,597 B2 9/2003 Dowling et al.
D481,484 S 10/2003 Cuevas et al.
6,634,770 B2 10/2003 Cao
6,634,779 B2 10/2003 Reed
6,636,003 B2 10/2003 Rahm et al.
6,639,349 B1 10/2003 Bahadur
6,641,284 B2 11/2003 Stopa et al.
6,652,117 B2 11/2003 Tsai
6,659,622 B2 12/2003 Katogi et al.
6,660,935 B2 12/2003 Southard et al.
6,666,689 B1 12/2003 Savage, Jr.
6,667,623 B2 12/2003 Bourgault et al.
6,674,096 B2 1/2004 Sommers
6,676,284 B1 1/2004 Wynne Willson
6,679,621 B2 1/2004 West et al.
6,681,154 B2 1/2004 Nierlich et al.
6,682,205 B2 1/2004 Lin
6,683,419 B2 1/2004 Kriparos
6,700,136 B2 3/2004 Guida
6,712,486 B1 3/2004 Popovich et al.
6,717,376 B2 4/2004 Lys et al.
6,717,526 B2 4/2004 Martineau et al.
6,720,745 B2 4/2004 Lys et al.
6,726,348 B2 4/2004 Gloisten
6,736,525 B2 5/2004 Chin
6,741,324 B1 5/2004 Kim
D491,678 S 6/2004 Piepgras
D492,042 S 6/2004 Piepgras
6,744,223 B2 6/2004 Laflamme et al.
6,748,299 B1 6/2004 Motoyama
6,762,562 B2 7/2004 Leong
6,768,047 B2 7/2004 Chang et al.
6,774,584 B2 8/2004 Lys et al.
6,777,891 B2 8/2004 Lys et al.
6,781,329 B2 8/2004 Mueller et al.
6,787,999 B2 9/2004 Stimac et al.
6,788,000 B2 9/2004 Appelberg et al.
6,788,011 B2 9/2004 Mueller et al.
6,791,840 B2 9/2004 Chun
6,796,680 B1 9/2004 Showers et al.
6,799,864 B2 10/2004 Bohler et al.
6,801,003 B2 10/2004 Schanberger et al.
6,803,732 B2 10/2004 Kraus et al.
6,806,659 B1 10/2004 Mueller et al.
6,814,470 B2 11/2004 Rizkin et al.
6,814,478 B2 11/2004 Menke
6,815,724 B2 11/2004 Dry
6,846,094 B2 1/2005 Luk
6,851,816 B2 2/2005 Wu et al.
6,851,832 B2 2/2005 Tieszen
6,853,150 B2 2/2005 Clauberg et al.
6,853,151 B2 2/2005 Leong et al.
6,853,563 B1 2/2005 Yang et al.
6,857,924 B2 2/2005 Fu et al.
6,860,628 B2 3/2005 Robertson et al.
6,866,401 B2 3/2005 Sommers et al.
6,869,204 B2 3/2005 Morgan et al.
6,871,981 B2 3/2005 Alexanderson et al.
6,874,924 B1 4/2005 Hulse et al.
6,879,883 B1 4/2005 Motoyama
6,883,929 B2 4/2005 Dowling
6,883,934 B2 4/2005 Kawakami et al.
6,888,322 B2 5/2005 Dowling et al.
6,897,624 B2 5/2005 Lys et al.
D506,274 S 6/2005 Moriyama et al.
6,909,239 B2 6/2005 Gauna
6,909,921 B1 6/2005 Bilger
6,918,680 B2 7/2005 Seeberger
6,921,181 B2 7/2005 Yen
6,926,419 B2 8/2005 An
6,936,968 B2 8/2005 Cross et al.
6,936,978 B2 8/2005 Morgan et al.
6,940,230 B2 9/2005 Myron et al.
6,948,829 B2 9/2005 Verdes et al.
6,953,261 B1 10/2005 Jiao et al.
6,957,905 B1 10/2005 Pritchard et al.
6,963,175 B2 11/2005 Archenhold et al.
6,964,501 B2 11/2005 Ryan
6,965,197 B2 11/2005 Tyan et al.
6,965,205 B2 11/2005 Piepgras et al.
6,967,448 B2 11/2005 Morgan et al.
6,969,179 B2 11/2005 Sloan et al.
6,969,186 B2 11/2005 Sonderegger et al.
6,969,954 B2 11/2005 Lys
6,975,079 B2 12/2005 Lys et al.
6,979,097 B2 12/2005 Elam et al.
6,982,518 B2 1/2006 Chou et al.
6,995,681 B2 2/2006 Pederson
6,997,576 B1 2/2006 Lodhie et al.
6,999,318 B2 2/2006 Newby
7,004,603 B2 2/2006 Knight
D518,218 S 3/2006 Roberge et al.
7,008,079 B2 3/2006 Smith
7,014,336 B1 3/2006 Ducharme et al.
7,015,650 B2 3/2006 McGrath
7,018,063 B2 3/2006 Michael et al.
7,018,074 B2 3/2006 Raby et al.
7,021,799 B2 4/2006 Mizuyoshi
7,021,809 B2 4/2006 Iwasa et al.
7,024,256 B2 4/2006 Krzyzanowski et al.
7,029,145 B2 4/2006 Frederick
7,031,920 B2 4/2006 Dowling et al.
7,033,036 B2 4/2006 Pederson
7,038,398 B1 5/2006 Lys et al.
7,038,399 B2 5/2006 Lys et al.
7,042,172 B2 5/2006 Dowling et al.
7,048,423 B2 5/2006 Stepanenko et al.
7,049,761 B2 5/2006 Timmermans et al.
7,052,171 B1 5/2006 Lefebvre et al.
7,053,557 B2 5/2006 Cross et al.
7,064,498 B2 6/2006 Dowling et al.
7,064,674 B2 6/2006 Pederson
7,067,992 B2 6/2006 Leong et al.
7,077,978 B2 7/2006 Setlur et al.
7,080,927 B2 7/2006 Feuerborn et al.
7,086,747 B2 8/2006 Nielson et al.
7,088,014 B2 8/2006 Nierlich et al.
7,088,904 B2 8/2006 Ryan, Jr.
7,102,902 B1 9/2006 Brown et al.
7,113,541 B1 9/2006 Lys et al.
7,114,830 B2 10/2006 Robertson et al.
7,114,834 B2 10/2006 Rivas et al.
7,118,262 B2 10/2006 Negley
7,119,503 B2 10/2006 Kemper
7,120,560 B2 10/2006 Williams et al.
7,121,679 B2 10/2006 Fujimoto
7,122,976 B1 10/2006 Null et al.
7,128,442 B2 10/2006 Lee et al.
7,128,454 B2 10/2006 Kim et al.
D532,532 S 11/2006 Maxik
7,132,635 B2 11/2006 Dowling
7,132,785 B2 11/2006 Ducharme
7,132,804 B2 11/2006 Lys et al.
7,135,824 B2 11/2006 Lys et al.
7,139,617 B1 11/2006 Morgan et al.
7,144,135 B2 12/2006 Martin et al.
7,153,002 B2 12/2006 Kim et al.
7,161,311 B2 1/2007 Mueller et al.
7,161,313 B2 1/2007 Piepgras et al.
7,161,556 B2 1/2007 Morgan et al.
7,164,110 B2 1/2007 Pitigoi-Aron et al.
7,164,235 B2 1/2007 Ito et al.
7,165,863 B1 1/2007 Thomas et al.
7,165,866 B2 1/2007 Li
7,167,777 B2 1/2007 Budike, Jr.
7,168,843 B2 1/2007 Striebel
D536,468 S 2/2007 Crosby

(56) References Cited

U.S. PATENT DOCUMENTS 7,178,941 B2 2/2007 Roberge et al.
7,180,252 B2 2/2007 Lys et al.
D538,950 S 3/2007 Maxik
D538,952 S 3/2007 Maxik et al.
D538,962 S 3/2007 Elliott
7,186,003 B2 3/2007 Dowling et al.
7,186,005 B2 3/2007 Hulse
7,187,141 B2 3/2007 Mueller et al.
7,190,126 B1 3/2007 Paton
7,192,154 B2 3/2007 Becker
7,198,387 B1 4/2007 Gloisten et al.
7,201,491 B2 4/2007 Bayat et al.
7,201,497 B2 4/2007 Weaver, Jr. et al.
7,202,613 B2 4/2007 Morgan et al.
7,204,615 B2 4/2007 Arik et al.
7,204,622 B2 4/2007 Dowling et al.
7,207,696 B1 4/2007 Lin
7,210,818 B2 5/2007 Luk et al.
7,210,957 B2 5/2007 Mrakovich et al.
7,211,959 B1 5/2007 Chou
7,213,934 B2 5/2007 Zarian et al.
7,217,004 B2 5/2007 Park et al.
7,217,012 B2 5/2007 Southard et al.
7,217,022 B2 5/2007 Ruffin
7,218,056 B1 5/2007 Harwood
7,218,238 B2 5/2007 Right et al.
7,220,015 B2 5/2007 Dowling
7,220,018 B2 5/2007 Crabb et al.
7,221,104 B2 5/2007 Lys et al.
7,221,110 B2 5/2007 Sears et al.
7,224,000 B2 5/2007 Aanegola et al.
7,226,189 B2 6/2007 Lee et al.
7,228,052 B1 6/2007 Lin
7,228,190 B2 6/2007 Dowling et al.
7,231,060 B2 6/2007 Dowling et al.
7,233,115 B2 6/2007 Lys
7,233,831 B2 6/2007 Blackwell
7,236,366 B2 6/2007 Chen
7,237,924 B2 7/2007 Martineau et al.
7,237,925 B2 7/2007 Mayer et al.
7,239,532 B1 7/2007 Hsu et al.
7,241,038 B2 7/2007 Naniwa et al.
7,242,152 B2 7/2007 Dowling et al.
7,246,926 B2 7/2007 Harwood
7,246,931 B2 7/2007 Hsieh et al.
7,248,239 B2 7/2007 Dowling et al.
7,249,269 B1 7/2007 Motoyama
7,249,865 B2 7/2007 Robertson
D548,868 S 8/2007 Roberge et al.
7,252,408 B2 8/2007 Mazzochette et al.
7,253,566 B2 8/2007 Lys et al.
7,255,457 B2 8/2007 Ducharme et al.
7,255,460 B2 8/2007 Lee
7,256,554 B2 8/2007 Lys
7,258,458 B2 8/2007 Mochiachvili et al.
7,258,467 B2 8/2007 Saccomanno et al.
7,259,528 B2 8/2007 Pilz
7,262,439 B2 8/2007 Setlur et al.
7,262,559 B2 8/2007 Tripathi et al.
D550,379 S 9/2007 Hoshikawa et al.
7,264,372 B2 9/2007 Maglica
7,267,467 B2 9/2007 Wu et al.
7,270,443 B2 9/2007 Kurtz et al.
7,271,794 B1 9/2007 Cheng et al.
7,273,300 B2 9/2007 Mrakovich
7,274,045 B2 9/2007 Chandran et al.
7,274,160 B2 9/2007 Mueller et al.
D553,267 S 10/2007 Yuen
7,285,801 B2 10/2007 Eliashevich et al.
7,288,902 B1 10/2007 Melanson
7,288,904 B2 10/2007 Numeroli et al.
7,296,912 B2 11/2007 Beauchamp
7,300,184 B2 11/2007 Ichikawa et al.
7,300,192 B2 11/2007 Mueller et al.
D556,937 S 12/2007 Ly
D557,854 S 12/2007 Lewis
7,303,300 B2 12/2007 Dowling et al.
7,306,353 B2 12/2007 Popovich et al.
7,307,391 B2 12/2007 Shan
7,308,296 B2 12/2007 Lys et al.
7,309,965 B2 12/2007 Dowling et al.
7,318,658 B2 1/2008 Wang et al.
7,319,244 B2 1/2008 Liu et al.
7,319,246 B2 1/2008 Soules et al.
7,321,191 B2 1/2008 Setlur et al.
7,326,964 B2 2/2008 Lim et al.
7,327,281 B2 2/2008 Hutchison
7,329,024 B2 2/2008 Lynch et al.
7,329,031 B2 2/2008 Liaw et al.
D563,589 S 3/2008 Hariri et al.
7,344,278 B2 3/2008 Paravantsos
7,345,320 B2 3/2008 Dahm
7,348,604 B2 3/2008 Matheson
7,350,936 B2 4/2008 Ducharme et al.
7,350,952 B2 4/2008 Nishigaki
7,352,138 B2 4/2008 Lys et al.
7,352,339 B2 4/2008 Morgan et al.
7,353,071 B2 4/2008 Blackwell et al.
7,358,679 B2 4/2008 Lys et al.
7,358,929 B2 4/2008 Mueller et al.
7,370,986 B2 5/2008 Chan
7,374,327 B2 5/2008 Schexnaider
7,378,805 B2 5/2008 Oh et al.
7,378,976 B1 5/2008 Paterno
7,385,359 B2 6/2008 Dowling et al.
7,391,159 B2 6/2008 Harwood
D574,093 S 7/2008 Kitagawa et al.
7,396,142 B2 7/2008 Laizure, Jr. et al.
7,396,146 B2 7/2008 Wang
7,401,935 B2 7/2008 VanderSchuit
7,401,945 B2 7/2008 Zhang
D576,749 S 9/2008 Kitagawa et al.
7,423,548 B2 9/2008 Kontovich
7,427,840 B2 9/2008 Morgan et al.
7,429,117 B2 9/2008 Pohlert et al.
7,434,964 B1 10/2008 Zheng et al.
7,438,441 B2 10/2008 Sun et al.
D580,089 S 11/2008 Ly et al.
D581,556 S 11/2008 To et al.
7,449,847 B2 11/2008 Schanberger et al.
D582,577 S 12/2008 Yuen
7,470,046 B2 12/2008 Kao et al.
D584,428 S 1/2009 Li et al.
D584,429 S 1/2009 Pei et al.
7,476,002 B2 1/2009 Wolf et al.
7,476,004 B2 1/2009 Chan
7,478,924 B2 1/2009 Robertson
D586,484 S 2/2009 Liu et al.
D586,928 S 2/2009 Liu et al.
7,490,957 B2 2/2009 Leong et al.
7,497,596 B2 3/2009 Ge
7,498,753 B2 3/2009 McAvoy et al.
7,507,001 B2 3/2009 Kit
7,510,299 B2 3/2009 Timmermans et al.
7,510,400 B2 3/2009 Glovatsky et al.
7,514,876 B2 4/2009 Roach, Jr.
7,520,635 B2 4/2009 Wolf et al.
7,521,872 B2 4/2009 Bruning
7,524,089 B2 4/2009 Park
D592,766 S 5/2009 Zhu et al.
D593,223 S 5/2009 Komar
7,530,701 B2 5/2009 Chan-Wing
7,534,002 B2 5/2009 Yamaguchi et al.
D594,999 S 6/2009 Uchida et al.
7,549,769 B2 6/2009 Kim et al.
7,556,396 B2 7/2009 Kuo et al.
7,559,663 B2 7/2009 Wong et al.
7,562,998 B1 7/2009 Yen
D597,686 S 8/2009 Noh
7,569,981 B1 8/2009 Ciancanelli
7,572,030 B2 8/2009 Booth et al.
7,575,339 B2 8/2009 Hung
7,579,786 B2 8/2009 Soos
7,583,035 B2 9/2009 Shteynberg et al.

(56) References Cited

U.S. PATENT DOCUMENTS 7,583,901 B2 9/2009 Nakagawa et al.
7,594,738 B1 * 9/2009 Lin et al. ..... 362/249.02
D601,726 S 10/2009 Mollaert et al.
7,598,681 B2 10/2009 Lys et al.
7,598,684 B2 10/2009 Lys et al.
7,600,907 B2 10/2009 Liu et al.
7,602,559 B2 10/2009 Jang et al.
7,618,157 B1 11/2009 Galvez et al.
7,619,366 B2 11/2009 Diederiks
7,635,201 B2 12/2009 Deng
7,635,214 B2 12/2009 Perlo
7,639,517 B2 12/2009 Zhou et al.
7,648,251 B2 1/2010 Whitehouse et al.
D610,724 S 2/2010 Chiang et al.
7,661,839 B2 2/2010 Tsai
D612,528 S 3/2010 McGrath et al.
7,690,813 B2 4/2010 Kanamori et al.
7,710,047 B2 5/2010 Shteynberg et al.
7,710,253 B1 5/2010 Fredricks
7,712,918 B2 5/2010 Siemiet et al.
7,748,886 B2 7/2010 Pazula et al.
7,758,207 B1 7/2010 Zhou et al.
7,759,881 B1 7/2010 Melanson
D621,975 S 8/2010 Wang
7,784,966 B2 8/2010 Verfuerth et al.
7,800,511 B1 9/2010 Hutchison et al.
7,815,338 B2 10/2010 Siemiet et al.
7,815,341 B2 10/2010 Steedly et al.
7,828,471 B2 11/2010 Lin
7,843,150 B2 11/2010 Wang et al.
7,848,702 B2 12/2010 Ho et al.
7,850,341 B2 12/2010 Mrakovich et al.
RE42,161 E 2/2011 Hochstein
7,878,683 B2 2/2011 Logan et al.
7,887,216 B2 2/2011 Patrick
7,887,226 B2 2/2011 Huang et al.
D634,452 S 3/2011 de Visser
7,926,975 B2 4/2011 Siemiet et al.
7,938,562 B2 5/2011 Ivey et al.
7,946,729 B2 5/2011 Ivey et al.
7,976,196 B2 7/2011 Ivey et al.
7,990,070 B2 8/2011 Nerone
7,997,770 B1 8/2011 Meurer
8,013,472 B2 9/2011 Adest et al.
D650,097 S 12/2011 Trumble et al.
D650,494 S 12/2011 Tsao et al.
D652,968 S 1/2012 Aguiar et al.
8,093,823 B1 1/2012 Ivey et al.
D654,192 S 2/2012 Maxik et al.
8,118,447 B2 2/2012 Simon et al.
8,159,152 B1 4/2012 Salessi
D660,472 S 5/2012 Aguiar et al.
8,167,452 B2 5/2012 Chou
8,177,388 B2 5/2012 Yen
8,179,037 B2 5/2012 Chan et al.
8,183,989 B2 5/2012 Tsai
D662,236 S 6/2012 Matsushita
8,203,445 B2 6/2012 Recker et al.
8,214,084 B2 7/2012 Ivey et al.
8,247,985 B2 8/2012 Timmermans et al.
8,251,544 B2 8/2012 Ivey et al.
8,262,249 B2 9/2012 Hsia et al.
8,272,764 B2 9/2012 Son
8,287,144 B2 10/2012 Pedersen et al.
8,297,788 B2 10/2012 Bishop
8,299,722 B2 10/2012 Melanson
8,304,993 B2 11/2012 Tzou et al.
8,313,213 B2 11/2012 Lin et al.
8,319,407 B2 11/2012 Ke
8,319,433 B2 11/2012 Lin et al.
8,319,437 B2 11/2012 Carlin et al.
8,322,878 B2 12/2012 Hsia et al.
8,324,817 B2 12/2012 Ivey et al.
8,337,071 B2 12/2012 Negley et al.
8,376,579 B2 2/2013 Chang
8,376,588 B2 2/2013 Yen
8,382,322 B2 2/2013 Bishop
8,382,327 B2 2/2013 Timmermans et al.
8,382,502 B2 2/2013 Cao et al.
8,398,275 B2 3/2013 Wang et al.
8,403,692 B2 3/2013 Cao et al.
8,405,314 B2 3/2013 Jensen
8,434,914 B2 5/2013 Li et al.
8,454,193 B2 6/2013 Simon et al.
2001/0033488 A1 10/2001 Chliwnyj et al.
2001/0045803 A1 11/2001 Cencur
2002/0011801 A1 1/2002 Chang
2002/0015297 A1 2/2002 Hayashi et al.
2002/0038157 A1 3/2002 Dowling et al.
2002/0044066 A1 4/2002 Dowling et al.
2002/0047516 A1 4/2002 Iwasa et al.
2002/0047569 A1 4/2002 Dowling et al.
2002/0047624 A1 4/2002 Stam et al.
2002/0047628 A1 4/2002 Morgan et al.
2002/0048169 A1 4/2002 Dowling et al.
2002/0057061 A1 5/2002 Mueller et al.
2002/0060526 A1 5/2002 Timmermans et al.
2002/0070688 A1 6/2002 Dowling et al.
2002/0074559 A1 6/2002 Dowling et al.
2002/0074958 A1 6/2002 Crenshaw
2002/0078221 A1 6/2002 Blackwell et al.
2002/0101197 A1 8/2002 Lys et al.
2002/0113555 A1 8/2002 Lys et al.
2002/0130627 A1 9/2002 Morgan et al.
2002/0145394 A1 10/2002 Morgan et al.
2002/0145869 A1 10/2002 Dowling
2002/0152045 A1 10/2002 Dowling et al.
2002/0152298 A1 10/2002 Kikta et al.
2002/0153851 A1 10/2002 Morgan et al.
2002/0158583 A1 10/2002 Lys et al.
2002/0163316 A1 11/2002 Lys et al.
2002/0171365 A1 11/2002 Morgan et al.
2002/0171377 A1 11/2002 Mueller et al.
2002/0171378 A1 11/2002 Morgan et al.
2002/0176259 A1 11/2002 Ducharme
2002/0179816 A1 12/2002 Haines et al.
2002/0195975 A1 12/2002 Schanberger et al.
2003/0011538 A1 1/2003 Lys et al.
2003/0021117 A1 1/2003 Chan
2003/0028260 A1 2/2003 Blackwell
2003/0031015 A1 2/2003 Ishibashi
2003/0048641 A1 3/2003 Alexanderson et al.
2003/0052599 A1 3/2003 Sun
2003/0057884 A1 3/2003 Dowling et al.
2003/0057886 A1 3/2003 Lys et al.
2003/0057887 A1 3/2003 Dowling et al.
2003/0057890 A1 3/2003 Lys et al.
2003/0076281 A1 4/2003 Morgan et al.
2003/0085710 A1 5/2003 Bourgault et al.
2003/0095404 A1 5/2003 Becks et al.
2003/0100837 A1 5/2003 Lys et al.
2003/0102810 A1 6/2003 Cross et al.
2003/0133292 A1 7/2003 Mueller et al.
2003/0137258 A1 7/2003 Piepgras et al.
2003/0185005 A1 10/2003 Sommers et al.
2003/0185014 A1 10/2003 Gloisten
2003/0189412 A1 10/2003 Cunningham
2003/0218879 A1 11/2003 Tieszen
2003/0222587 A1 12/2003 Dowling, Jr. et al.
2003/0234342 A1 12/2003 Gaines et al.
2004/0003545 A1 1/2004 Gillespie
2004/0007980 A1 1/2004 Shibata
2004/0012959 A1 1/2004 Robertson et al.
2004/0036006 A1 2/2004 Dowling
2004/0037088 A1 2/2004 English et al.
2004/0052076 A1 3/2004 Mueller et al.
2004/0062041 A1 4/2004 Cross et al.
2004/0075572 A1 4/2004 Buschmann et al.
2004/0080960 A1 4/2004 Wu
2004/0090191 A1 5/2004 Mueller et al.
2004/0090787 A1 5/2004 Dowling et al.
2004/0105261 A1 6/2004 Ducharme et al.
2004/0105264 A1 6/2004 Spero
2004/0113568 A1 6/2004 Dowling et al.

(56) References Cited

U.S. PATENT DOCUMENTS

| | | | |
|---|---|---|---|
| 2004/0114371 | A1 | 6/2004 | Lea et al. |
| 2004/0116039 | A1 | 6/2004 | Mueller et al. |
| 2004/0124782 | A1 | 7/2004 | Yu |
| 2004/0130908 | A1 | 7/2004 | McClurg et al. |
| 2004/0130909 | A1 | 7/2004 | Mueller et al. |
| 2004/0141321 | A1 | 7/2004 | Dowling et al. |
| 2004/0145886 | A1 | 7/2004 | Fatemi et al. |
| 2004/0155609 | A1 | 8/2004 | Lys et al. |
| 2004/0160199 | A1 | 8/2004 | Morgan et al. |
| 2004/0178751 | A1 | 9/2004 | Mueller et al. |
| 2004/0189262 | A1 | 9/2004 | McGrath |
| 2004/0212320 | A1 | 10/2004 | Dowling et al. |
| 2004/0212321 | A1 | 10/2004 | Lys et al. |
| 2004/0212993 | A1 | 10/2004 | Morgan et al. |
| 2004/0223328 | A1 | 11/2004 | Lee et al. |
| 2004/0240890 | A1 | 12/2004 | Lys et al. |
| 2004/0251854 | A1 | 12/2004 | Matsuda et al. |
| 2004/0257007 | A1 | 12/2004 | Lys et al. |
| 2005/0013133 | A1 | 1/2005 | Yeh |
| 2005/0024877 | A1 | 2/2005 | Frederick |
| 2005/0030744 | A1 | 2/2005 | Ducharme et al. |
| 2005/0035728 | A1 | 2/2005 | Schanberger et al. |
| 2005/0036300 | A1 | 2/2005 | Dowling et al. |
| 2005/0040774 | A1 | 2/2005 | Mueller et al. |
| 2005/0041161 | A1 | 2/2005 | Dowling et al. |
| 2005/0041424 | A1 | 2/2005 | Ducharme |
| 2005/0043907 | A1 | 2/2005 | Eckel et al. |
| 2005/0044617 | A1 | 3/2005 | Mueller et al. |
| 2005/0047132 | A1 | 3/2005 | Dowling et al. |
| 2005/0047134 | A1 | 3/2005 | Mueller et al. |
| 2005/0062440 | A1 | 3/2005 | Lys et al. |
| 2005/0063194 | A1 | 3/2005 | Lys et al. |
| 2005/0078477 | A1 | 4/2005 | Lo |
| 2005/0093488 | A1 | 5/2005 | Hung et al. |
| 2005/0099824 | A1 | 5/2005 | Dowling et al. |
| 2005/0107694 | A1 | 5/2005 | Jansen et al. |
| 2005/0110384 | A1 | 5/2005 | Peterson |
| 2005/0116667 | A1 | 6/2005 | Mueller et al. |
| 2005/0128751 | A1 | 6/2005 | Roberge et al. |
| 2005/0141225 | A1 | 6/2005 | Striebel |
| 2005/0151489 | A1 | 7/2005 | Lys et al. |
| 2005/0151663 | A1 | 7/2005 | Tanguay |
| 2005/0154494 | A1 | 7/2005 | Ahmed |
| 2005/0162093 | A1 | 7/2005 | Timmermans et al. |
| 2005/0162100 | A1 | 7/2005 | Romano et al. |
| 2005/0162101 | A1 | 7/2005 | Leong et al. |
| 2005/0174473 | A1 | 8/2005 | Morgan et al. |
| 2005/0174780 | A1 | 8/2005 | Park |
| 2005/0184667 | A1 | 8/2005 | Sturman et al. |
| 2005/0201112 | A1 | 9/2005 | Machi et al. |
| 2005/0206529 | A1 | 9/2005 | St.-Germain |
| 2005/0213320 | A1 | 9/2005 | Kazuhiro et al. |
| 2005/0213352 | A1 | 9/2005 | Lys |
| 2005/0213353 | A1 | 9/2005 | Lys |
| 2005/0218838 | A1 | 10/2005 | Lys |
| 2005/0218870 | A1 | 10/2005 | Lys |
| 2005/0219860 | A1 | 10/2005 | Schexnaider |
| 2005/0219872 | A1 | 10/2005 | Lys |
| 2005/0225979 | A1 | 10/2005 | Robertson et al. |
| 2005/0231133 | A1 | 10/2005 | Lys |
| 2005/0236029 | A1 | 10/2005 | Dowling |
| 2005/0236998 | A1 | 10/2005 | Mueller et al. |
| 2005/0242742 | A1 | 11/2005 | Cheang et al. |
| 2005/0243577 | A1 | 11/2005 | Moon |
| 2005/0248299 | A1 | 11/2005 | Chemel et al. |
| 2005/0253533 | A1 | 11/2005 | Lys et al. |
| 2005/0259424 | A1 | 11/2005 | Zampini, II et al. |
| 2005/0264474 | A1 | 12/2005 | Rast |
| 2005/0265019 | A1 | 12/2005 | Sommers et al. |
| 2005/0275626 | A1 | 12/2005 | Mueller et al. |
| 2005/0276051 | A1 | 12/2005 | Caudle et al. |
| 2005/0276053 | A1 | 12/2005 | Nortrup et al. |
| 2005/0276064 | A1 | 12/2005 | Wu et al. |
| 2005/0281030 | A1 | 12/2005 | Leong et al. |
| 2005/0285547 | A1 | 12/2005 | Piepgras et al. |
| 2006/0002110 | A1 | 1/2006 | Dowling et al. |
| 2006/0012987 | A9 | 1/2006 | Ducharme et al. |
| 2006/0012997 | A1 | 1/2006 | Catalano et al. |
| 2006/0016960 | A1 | 1/2006 | Morgan et al. |
| 2006/0022214 | A1 | 2/2006 | Morgan et al. |
| 2006/0028155 | A1 | 2/2006 | Young |
| 2006/0028837 | A1 | 2/2006 | Mrakovich |
| 2006/0034078 | A1 | 2/2006 | Kovacik et al. |
| 2006/0050509 | A9 | 3/2006 | Dowling et al. |
| 2006/0050514 | A1 | 3/2006 | Opolka |
| 2006/0056855 | A1 | 3/2006 | Nakagawa et al. |
| 2006/0066447 | A1 | 3/2006 | Davenport et al. |
| 2006/0076908 | A1 | 4/2006 | Morgan et al. |
| 2006/0081863 | A1 | 4/2006 | Kim et al. |
| 2006/0092640 | A1 | 5/2006 | Li |
| 2006/0098077 | A1 | 5/2006 | Dowling |
| 2006/0104058 | A1 | 5/2006 | Chemel et al. |
| 2006/0109648 | A1 | 5/2006 | Trenchard et al. |
| 2006/0109649 | A1 | 5/2006 | Ducharme et al. |
| 2006/0109661 | A1 | 5/2006 | Coushaine et al. |
| 2006/0126325 | A1 | 6/2006 | Lefebvre et al. |
| 2006/0126338 | A1 | 6/2006 | Mighetto |
| 2006/0132061 | A1 | 6/2006 | McCormick et al. |
| 2006/0132323 | A1 | 6/2006 | Grady, Jr. |
| 2006/0146531 | A1 | 7/2006 | Reo et al. |
| 2006/0152172 | A9 | 7/2006 | Mueller et al. |
| 2006/0158881 | A1 | 7/2006 | Dowling |
| 2006/0170376 | A1 | 8/2006 | Piepgras et al. |
| 2006/0192502 | A1 | 8/2006 | Brown et al. |
| 2006/0193131 | A1 | 8/2006 | McGrath et al. |
| 2006/0197661 | A1 | 9/2006 | Tracy et al. |
| 2006/0198128 | A1 | 9/2006 | Piepgras et al. |
| 2006/0208667 | A1 | 9/2006 | Lys et al. |
| 2006/0215422 | A1 | 9/2006 | Laizure, Jr. et al. |
| 2006/0220595 | A1 | 10/2006 | Lu |
| 2006/0221606 | A1 | 10/2006 | Dowling |
| 2006/0221619 | A1 | 10/2006 | Nishigaki |
| 2006/0227558 | A1 | 10/2006 | Osawa et al. |
| 2006/0232974 | A1 | 10/2006 | Lee et al. |
| 2006/0238884 | A1 | 10/2006 | Jang et al. |
| 2006/0262516 | A9 | 11/2006 | Dowling et al. |
| 2006/0262521 | A1 | 11/2006 | Piepgras et al. |
| 2006/0262544 | A1 | 11/2006 | Piepgras et al. |
| 2006/0262545 | A1 | 11/2006 | Piepgras et al. |
| 2006/0265921 | A1 | 11/2006 | Korall et al. |
| 2006/0273741 | A1 | 12/2006 | Stalker, III |
| 2006/0274529 | A1 | 12/2006 | Cao |
| 2006/0285325 | A1 | 12/2006 | Ducharme et al. |
| 2007/0035255 | A1 | 2/2007 | Shuster et al. |
| 2007/0035538 | A1 | 2/2007 | Garcia et al. |
| 2007/0035965 | A1 | 2/2007 | Holst |
| 2007/0040516 | A1 | 2/2007 | Chen |
| 2007/0041220 | A1 | 2/2007 | Lynch |
| 2007/0047227 | A1 | 3/2007 | Ducharme |
| 2007/0053182 | A1 | 3/2007 | Robertson |
| 2007/0053208 | A1 | 3/2007 | Justel et al. |
| 2007/0064419 | A1 | 3/2007 | Gandhi |
| 2007/0064425 | A1 | 3/2007 | Frecska et al. |
| 2007/0070621 | A1 | 3/2007 | Rivas et al. |
| 2007/0070631 | A1 | 3/2007 | Huang et al. |
| 2007/0081423 | A1 | 4/2007 | Chien |
| 2007/0086754 | A1 | 4/2007 | Lys et al. |
| 2007/0086912 | A1 | 4/2007 | Dowling et al. |
| 2007/0097678 | A1 | 5/2007 | Yang |
| 2007/0109763 | A1 | 5/2007 | Wolf et al. |
| 2007/0115658 | A1 | 5/2007 | Mueller et al. |
| 2007/0115665 | A1 | 5/2007 | Mueller et al. |
| 2007/0120463 | A1 | 5/2007 | Hayashi et al. |
| 2007/0120594 | A1 | 5/2007 | Balakrishnan et al. |
| 2007/0127234 | A1 | 6/2007 | Jervey, III |
| 2007/0133202 | A1 | 6/2007 | Huang et al. |
| 2007/0139938 | A1 | 6/2007 | Petroski et al. |
| 2007/0145915 | A1 | 6/2007 | Roberge et al. |
| 2007/0146126 | A1 | 6/2007 | Wang |
| 2007/0147046 | A1 | 6/2007 | Arik et al. |
| 2007/0152797 | A1 | 7/2007 | Chemel et al. |
| 2007/0152808 | A1 | 7/2007 | LaCasse |
| 2007/0153514 | A1 | 7/2007 | Dowling et al. |
| 2007/0159828 | A1 | 7/2007 | Wang |

(56) References Cited

U.S. PATENT DOCUMENTS

2007/0165402 A1 7/2007 Weaver, Jr. et al.
2007/0165405 A1 7/2007 Chen
2007/0173978 A1 7/2007 Fein et al.
2007/0177382 A1 8/2007 Pritchard et al.
2007/0182387 A1 8/2007 Weirich
2007/0188114 A1 8/2007 Lys et al.
2007/0188427 A1 8/2007 Lys et al.
2007/0189026 A1 8/2007 Chemel et al.
2007/0195526 A1 8/2007 Dowling et al.
2007/0195527 A1 8/2007 Russell
2007/0195532 A1 8/2007 Reisenauer et al.
2007/0200725 A1 8/2007 Fredericks et al.
2007/0205712 A1 9/2007 Radkov et al.
2007/0206375 A1 9/2007 Piepgras et al.
2007/0211461 A1 9/2007 Harwood
2007/0211463 A1 9/2007 Chevalier et al.
2007/0228999 A1 10/2007 Kit
2007/0235751 A1 10/2007 Radkov et al.
2007/0236156 A1 10/2007 Lys et al.
2007/0236358 A1 10/2007 Street et al.
2007/0237284 A1 10/2007 Lys et al.
2007/0240346 A1 10/2007 Li et al.
2007/0241657 A1 10/2007 Radkov et al.
2007/0242466 A1 10/2007 Wu et al.
2007/0247450 A1 10/2007 Lee
2007/0247842 A1 10/2007 Zampini et al.
2007/0247847 A1 10/2007 Villard
2007/0247851 A1 10/2007 Villard
2007/0252161 A1 11/2007 Meis et al.
2007/0258231 A1 11/2007 Koerner et al.
2007/0258240 A1 11/2007 Ducharme et al.
2007/0263379 A1 11/2007 Dowling
2007/0274070 A1 11/2007 Wedell
2007/0281520 A1 12/2007 Insalaco et al.
2007/0285926 A1 12/2007 Maxik
2007/0285933 A1 12/2007 Southard et al.
2007/0290625 A1 12/2007 He et al.
2007/0291483 A1 12/2007 Lys
2007/0296350 A1 12/2007 Maxik et al.
2008/0003664 A1 1/2008 Tysoe et al.
2008/0007945 A1 1/2008 Kelly et al.
2008/0012502 A1 1/2008 Lys
2008/0012506 A1 1/2008 Mueller et al.
2008/0013316 A1 1/2008 Chiang
2008/0013324 A1 1/2008 Yu
2008/0018261 A1 1/2008 Kastner
2008/0024067 A1 1/2008 Ishibashi
2008/0037226 A1 2/2008 Shin et al.
2008/0037245 A1 2/2008 Chan
2008/0037284 A1 2/2008 Rudisill
2008/0049434 A1 2/2008 Marsh
2008/0055894 A1 3/2008 Deng
2008/0062680 A1 3/2008 Timmermans et al.
2008/0068838 A1 3/2008 Galke et al.
2008/0068839 A1 3/2008 Matheson
2008/0074872 A1 3/2008 Panotopoulos
2008/0089075 A1 4/2008 Hsu
2008/0092800 A1 4/2008 Smith et al.
2008/0093615 A1 4/2008 Lin et al.
2008/0093998 A1 4/2008 Dennery et al.
2008/0094819 A1 4/2008 Vaish
2008/0094837 A1 4/2008 Dobbins et al.
2008/0129211 A1 6/2008 Lin et al.
2008/0130267 A1 6/2008 Dowling et al.
2008/0150444 A1 6/2008 Usui et al.
2008/0151535 A1 6/2008 de Castris
2008/0158871 A1 7/2008 McAvoy et al.
2008/0158887 A1 7/2008 Zhu et al.
2008/0164826 A1 7/2008 Lys
2008/0164827 A1 7/2008 Lys
2008/0164854 A1 7/2008 Lys
2008/0175003 A1 7/2008 Tsou et al.
2008/0180036 A1 7/2008 Garrity et al.
2008/0186704 A1 8/2008 Chou et al.
2008/0192436 A1 8/2008 Peng et al.
2008/0198598 A1 8/2008 Ward
2008/0211386 A1 9/2008 Choi et al.
2008/0211419 A1 9/2008 Garrity
2008/0218993 A1 9/2008 Li
2008/0224629 A1 9/2008 Melanson
2008/0224636 A1 9/2008 Melanson
2008/0253125 A1 10/2008 Kang et al.
2008/0258631 A1 10/2008 Wu et al.
2008/0258647 A1 10/2008 Scianna
2008/0278092 A1 11/2008 Lys et al.
2008/0285257 A1 11/2008 King
2008/0285266 A1 11/2008 Thomas
2008/0290814 A1 11/2008 Leong et al.
2008/0291675 A1 11/2008 Lin et al.
2008/0298080 A1 12/2008 Wu et al.
2008/0310119 A1 12/2008 Giacoma
2008/0315773 A1 12/2008 Pang
2008/0315784 A1 12/2008 Tseng
2009/0002995 A1 1/2009 Lee et al.
2009/0016063 A1 1/2009 Hu
2009/0021140 A1 1/2009 Takasu et al.
2009/0046473 A1 2/2009 Tsai et al.
2009/0052186 A1 2/2009 Xue
2009/0059557 A1 3/2009 Tanaka
2009/0059559 A1 3/2009 Pabst et al.
2009/0059603 A1 3/2009 Recker et al.
2009/0067170 A1 3/2009 Bloemen et al.
2009/0067182 A1 3/2009 Hsu et al.
2009/0085500 A1 4/2009 Zampini, II et al.
2009/0086492 A1 4/2009 Meyer
2009/0091929 A1 4/2009 Faubion
2009/0091938 A1 4/2009 Jacobson et al.
2009/0101930 A1 4/2009 Li
2009/0139690 A1 6/2009 Maerz et al.
2009/0140285 A1 6/2009 Lin et al.
2009/0175041 A1 7/2009 Yuen et al.
2009/0185373 A1 7/2009 Grajcar
2009/0195186 A1 8/2009 Guest et al.
2009/0196034 A1 8/2009 Gherardini et al.
2009/0213588 A1 8/2009 Manes
2009/0219713 A1 9/2009 Siemiet et al.
2009/0231831 A1 9/2009 Hsiao et al.
2009/0268461 A1 10/2009 Deak et al.
2009/0273924 A1 11/2009 Chiang
2009/0273926 A1 11/2009 Deng
2009/0284169 A1 11/2009 Valois
2009/0290334 A1 11/2009 Ivey et al.
2009/0295776 A1 12/2009 Yu et al.
2009/0303720 A1 12/2009 McGrath
2009/0316408 A1 12/2009 Villard
2010/0008085 A1 1/2010 Ivey et al.
2010/0019689 A1 1/2010 Shan
2010/0027259 A1 2/2010 Simon et al.
2010/0033095 A1 2/2010 Sadwick
2010/0033964 A1 2/2010 Choi et al.
2010/0046222 A1 2/2010 Yang
2010/0073944 A1 3/2010 Chen
2010/0079085 A1 4/2010 Wendt et al.
2010/0096992 A1 4/2010 Yamamoto et al.
2010/0096998 A1 4/2010 Beers
2010/0103664 A1 4/2010 Simon et al.
2010/0103673 A1 4/2010 Ivey et al.
2010/0109550 A1 5/2010 Huda et al.
2010/0109558 A1 5/2010 Chew
2010/0141173 A1 6/2010 Negrete
2010/0148650 A1 6/2010 Wu et al.
2010/0149806 A1 6/2010 Yiu
2010/0157608 A1 6/2010 Chen et al.
2010/0164404 A1 7/2010 Shao et al.
2010/0181178 A1 7/2010 Chang et al.
2010/0201269 A1 8/2010 Tzou et al.
2010/0207547 A1 8/2010 Kuroki et al.
2010/0220469 A1 9/2010 Ivey et al.
2010/0265732 A1 10/2010 Liu
2010/0270925 A1 10/2010 Withers
2010/0277069 A1 11/2010 Janik et al.
2010/0289418 A1 11/2010 Langovsky
2010/0308733 A1 12/2010 Shao
2010/0309652 A1 12/2010 Shen et al.

(56) References Cited

U.S. PATENT DOCUMENTS

| | | | | |
|---|---|---|---|---|
| 2010/0320922 | A1 | 12/2010 | Palazzolo et al. | |
| 2011/0006658 | A1 | 1/2011 | Chan et al. | |
| 2011/0090682 | A1 | 4/2011 | Zheng et al. | |
| 2011/0109454 | A1 | 5/2011 | McSheffrey, Sr. et al. | |
| 2011/0140136 | A1* | 6/2011 | Daily et al. | 257/89 |
| 2011/0156584 | A1 | 6/2011 | Kim | |
| 2011/0176298 | A1 | 7/2011 | Meurer et al. | |
| 2011/0199723 | A1 | 8/2011 | Sato | |
| 2011/0199769 | A1 | 8/2011 | Bretschneider et al. | |
| 2011/0291588 | A1 | 12/2011 | Tagare | |
| 2012/0014086 | A1 | 1/2012 | Jonsson | |
| 2012/0043892 | A1 | 2/2012 | Visser et al. | |
| 2012/0063140 | A1 | 3/2012 | Kong | |
| 2012/0098439 | A1 | 4/2012 | Recker et al. | |
| 2012/0106144 | A1 | 5/2012 | Chang | |
| 2012/0113628 | A1 | 5/2012 | Burrow et al. | |
| 2012/0120660 | A1* | 5/2012 | Grauvogel | 362/249.02 |
| 2012/0127726 | A1 | 5/2012 | Yen | |
| 2012/0146503 | A1 | 6/2012 | Negley et al. | |
| 2012/0147597 | A1 | 6/2012 | Farmer | |
| 2012/0153865 | A1 | 6/2012 | Rolfes et al. | |
| 2012/0155073 | A1 | 6/2012 | McCanless et al. | |
| 2012/0161666 | A1 | 6/2012 | Antony et al. | |
| 2012/0194086 | A1 | 8/2012 | Liu et al. | |
| 2012/0195032 | A1 | 8/2012 | Shew | |
| 2012/0212951 | A1 | 8/2012 | Lai et al. | |
| 2012/0212953 | A1 | 8/2012 | Bloom et al. | |
| 2012/0230044 | A1 | 9/2012 | Zhang et al. | |
| 2012/0236533 | A1 | 9/2012 | Nakamura et al. | |
| 2012/0236554 | A1 | 9/2012 | Rust | |
| 2012/0243216 | A1 | 9/2012 | Lai et al. | |
| 2012/0243217 | A1 | 9/2012 | Szprengiel et al. | |
| 2012/0274214 | A1 | 11/2012 | Radermacher et al. | |
| 2012/0275154 | A1 | 11/2012 | Hood et al. | |
| 2012/0293991 | A1 | 11/2012 | Lin | |
| 2012/0293996 | A1 | 11/2012 | Thomas et al. | |
| 2012/0300445 | A1 | 11/2012 | Chu et al. | |
| 2012/0300468 | A1 | 11/2012 | Chang et al. | |
| 2012/0307524 | A1 | 12/2012 | Schapira et al. | |
| 2012/0320598 | A1 | 12/2012 | Son | |
| 2013/0010473 | A1* | 1/2013 | Dellian et al. | 362/249.02 |
| 2013/0039051 | A1 | 2/2013 | Wu | |
| 2013/0044471 | A1 | 2/2013 | Chen | |
| 2013/0044476 | A1 | 2/2013 | Bretschneider et al. | |
| 2013/0050997 | A1 | 2/2013 | Bretschneider et al. | |
| 2013/0050998 | A1 | 2/2013 | Chu et al. | |
| 2013/0057146 | A1 | 3/2013 | Chao | |
| 2013/0058079 | A1 | 3/2013 | Dellian et al. | |
| 2013/0063944 | A1 | 3/2013 | Lodhie et al. | |
| 2013/0077297 | A1 | 3/2013 | Wu et al. | |
| 2013/0094200 | A1 | 4/2013 | Dellian et al. | |
| 2013/0148349 | A1 | 6/2013 | Pasqualini et al. | |

FOREIGN PATENT DOCUMENTS

| | | | |
|---|---|---|---|
| CN | 2869556 | Y | 2/2007 |
| CN | 101016976 | A | 8/2007 |
| CN | 101075605 | A | 11/2007 |
| CN | 201129681 | Y | 10/2008 |
| CN | 201184574 | Y | 1/2009 |
| CN | 101737664 | A1 | 6/2010 |
| DE | 19651140 | A1 | 6/1997 |
| DE | 19624087 | A1 | 12/1997 |
| DE | 29819966 | U1 | 3/1999 |
| DE | 29817609 | U1 | 1/2000 |
| DE | 20018865 | U1 | 2/2001 |
| EP | 0013782 | B1 | 3/1983 |
| EP | 0091172 | A2 | 10/1983 |
| EP | 0124924 | B1 | 9/1987 |
| EP | 0174699 | B1 | 11/1988 |
| EP | 0197602 | B1 | 11/1990 |
| EP | 0714556 | | 1/1991 |
| EP | 0214701 | B1 | 3/1992 |
| EP | 0262713 | B1 | 6/1992 |
| EP | 0203668 | B1 | 2/1993 |
| EP | 0272749 | B1 | 8/1993 |
| EP | 0337567 | B1 | 11/1993 |
| EP | 0390262 | B1 | 12/1993 |
| EP | 0359329 | B1 | 3/1994 |
| EP | 0403011 | B1 | 4/1994 |
| EP | 0632511 | | 1/1995 |
| EP | 0432848 | B1 | 4/1995 |
| EP | 0659531 | A1 | 6/1995 |
| EP | 0403001 | B1 | 8/1995 |
| EP | 0525876 | | 5/1996 |
| EP | 0889283 | A1 | 7/1999 |
| EP | 0458408 | B1 | 9/1999 |
| EP | 0578302 | B1 | 9/1999 |
| EP | 0723701 | B1 | 1/2000 |
| EP | 1142452 | B1 | 3/2001 |
| EP | 0787419 | B1 | 5/2001 |
| EP | 1016062 | B1 | 8/2002 |
| EP | 1195740 | A3 | 1/2003 |
| EP | 1149510 | B1 | 2/2003 |
| EP | 1056993 | B1 | 3/2003 |
| EP | 0766436 | B1 | 5/2003 |
| EP | 0924281 | B1 | 5/2003 |
| EP | 0826167 | B1 | 6/2003 |
| EP | 1147686 | B1 | 1/2004 |
| EP | 1145602 | B1 | 3/2004 |
| EP | 1422975 | A1 | 5/2004 |
| EP | 0890059 | B1 | 6/2004 |
| EP | 1348319 | B1 | 6/2005 |
| EP | 1037862 | B1 | 7/2005 |
| EP | 1346609 | B1 | 8/2005 |
| EP | 1321012 | B1 | 12/2005 |
| EP | 1610593 | A2 | 12/2005 |
| EP | 1624728 | A1 | 2/2006 |
| EP | 1415517 | B1 | 5/2006 |
| EP | 1415518 | B1 | 5/2006 |
| EP | 1438877 | B1 | 5/2006 |
| EP | 1166604 | B1 | 6/2006 |
| EP | 1479270 | B1 | 7/2006 |
| EP | 1348318 | B1 | 8/2006 |
| EP | 1399694 | B1 | 8/2006 |
| EP | 1461980 | B1 | 10/2006 |
| EP | 1110120 | B1 | 4/2007 |
| EP | 1440604 | B1 | 4/2007 |
| EP | 1047903 | B1 | 6/2007 |
| EP | 1500307 | | 6/2007 |
| EP | 0922305 | B1 | 8/2007 |
| EP | 0922306 | B1 | 8/2007 |
| EP | 1194918 | B1 | 8/2007 |
| EP | 1833035 | A1 | 9/2007 |
| EP | 1048085 | B1 | 11/2007 |
| EP | 1852648 | A1 | 11/2007 |
| EP | 1763650 | B1 | 12/2007 |
| EP | 1776722 | B1 | 1/2008 |
| EP | 1873012 | A1 | 1/2008 |
| EP | 1459599 | B1 | 2/2008 |
| EP | 1887836 | A2 | 2/2008 |
| EP | 1579733 | B1 | 4/2008 |
| EP | 1145282 | B1 | 7/2008 |
| EP | 1157428 | B1 | 9/2008 |
| EP | 1000522 | B1 | 12/2008 |
| EP | 1502483 | B1 | 12/2008 |
| EP | 1576858 | B1 | 12/2008 |
| EP | 1646092 | B1 | 1/2009 |
| EP | 1579736 | B1 | 2/2009 |
| EP | 1889519 | B1 | 3/2009 |
| EP | 1537354 | B1 | 4/2009 |
| EP | 1518445 | B1 | 5/2009 |
| EP | 1337784 | B1 | 6/2009 |
| EP | 2013530 | B1 | 8/2009 |
| EP | 1461982 | B1 | 9/2009 |
| EP | 2333407 | A1 | 6/2011 |
| EP | 2430888 | | 3/2012 |
| EP | 2469155 | A1 | 6/2012 |
| EP | 2573457 | A1 | 3/2013 |
| EP | 2554895 | A1 | 6/2013 |
| FR | 2813115 | | 2/2002 |
| GB | 2215024 | A | 9/1989 |
| GB | 2324901 | A | 11/1998 |

(56) References Cited

FOREIGN PATENT DOCUMENTS

| | | | |
|---|---|---|---|
| GB | 2447257 | A | 9/2008 |
| GB | 2472345 | A | 2/2011 |
| GB | 2486410 | A | 6/2012 |
| JP | 06-054289 | | 2/1994 |
| JP | H6-54103 | U | 7/1994 |
| JP | 07-249467 | | 9/1995 |
| JP | 7264036 | | 10/1995 |
| JP | 08-162677 | A | 6/1996 |
| JP | 11-135274 | A | 5/1999 |
| JP | H11-162234 | A | 6/1999 |
| JP | H11-260125 | A | 9/1999 |
| JP | 2001-238272 | A | 8/2001 |
| JP | 2001-291406 | A | 10/2001 |
| JP | 2002-141555 | A | 5/2002 |
| JP | 3098271 | U | 2/2004 |
| JP | 2004-119078 | A | 4/2004 |
| JP | 2004-273234 | A | 9/2004 |
| JP | 2004-335426 | | 11/2004 |
| JP | 2005-158363 | A | 6/2005 |
| JP | 2005-166617 | A | 6/2005 |
| JP | 2005-347214 | A | 12/2005 |
| JP | 2006-507641 | A | 3/2006 |
| JP | 2005-322866 | A | 12/2006 |
| JP | 2007-227342 | A | 9/2007 |
| JP | 3139714 | U | 2/2008 |
| JP | 2008-186758 | A | 8/2008 |
| JP | 2008-258124 | A | 10/2008 |
| JP | 2008-293753 | A | 12/2008 |
| JP | 3154200 | | 9/2009 |
| JP | 2010-192229 | A1 | 9/2010 |
| JP | 2010-205553 | A | 9/2010 |
| KR | 10-2004-0008244 | A | 1/2004 |
| KR | 10-2006-0112113 | A | 10/2006 |
| KR | 20-0430022 | Y1 | 11/2006 |
| KR | 10-2006-0133784 | A | 12/2006 |
| KR | 10-2007-0063595 | A | 6/2007 |
| KR | 10-0781652 | | 12/2007 |
| KR | 10-0844538 | B1 | 7/2008 |
| KR | 10-0888669 | B1 | 3/2009 |
| KR | 10-0927851 | B1 | 11/2009 |
| TW | M337036 | | 7/2008 |
| TW | M349465 | U | 1/2009 |
| WO | 99-06759 | A1 | 2/1999 |
| WO | 99-10867 | A1 | 3/1999 |
| WO | 99-31560 | A2 | 6/1999 |
| WO | 99/45312 | A1 | 9/1999 |
| WO | 99/57945 | A1 | 11/1999 |
| WO | 00/01067 | A2 | 1/2000 |
| WO | WO0225842 | A2 | 3/2002 |
| WO | 02-61330 | | 8/2002 |
| WO | WO02069306 | A2 | 9/2002 |
| WO | WO02091805 | A2 | 11/2002 |
| WO | WO02098182 | A2 | 12/2002 |
| WO | WO02099780 | A2 | 12/2002 |
| WO | WO03026358 | A1 | 3/2003 |
| WO | WO03055273 | A2 | 7/2003 |
| WO | WO03067934 | A2 | 8/2003 |
| WO | WO03090890 | A1 | 11/2003 |
| WO | WO03096761 | A1 | 11/2003 |
| WO | WO2004021747 | A2 | 3/2004 |
| WO | WO2004023850 | A2 | 3/2004 |
| WO | WO2004032572 | A2 | 4/2004 |
| WO | WO2004057924 | | 7/2004 |
| WO | WO2004100624 | A2 | 11/2004 |
| WO | WO2005031860 | A2 | 4/2005 |
| WO | WO2005052751 | A2 | 6/2005 |
| WO | WO2005060309 | A2 | 6/2005 |
| WO | WO2005084339 | A2 | 9/2005 |
| WO | WO2005089293 | A2 | 9/2005 |
| WO | WO2005089309 | A2 | 9/2005 |
| WO | WO2005103555 | A1 | 11/2005 |
| WO | WO2005116519 | A1 | 12/2005 |
| WO | WO2006023149 | A2 | 3/2006 |
| WO | WO2006044328 | A1 | 4/2006 |
| WO | WO2006046207 | A1 | 5/2006 |
| WO | WO2006056120 | A1 | 6/2006 |
| WO | WO2006093889 | A2 | 9/2006 |
| WO | WO2006127666 | A2 | 11/2006 |
| WO | WO2006127785 | A2 | 11/2006 |
| WO | WO2006133272 | A2 | 12/2006 |
| WO | WO2006137686 | A1 | 12/2006 |
| WO | WO2007004679 | A1 | 1/2007 |
| WO | WO2007081674 | A1 | 7/2007 |
| WO | WO2007090292 | A1 | 8/2007 |
| WO | WO2007094810 | A2 | 8/2007 |
| WO | WO2008018002 | A2 | 2/2008 |
| WO | WO2008027093 | A2 | 3/2008 |
| WO | WO2008061991 | A1 | 5/2008 |
| WO | WO2008110978 | A1 | 9/2008 |
| WO | WO2008137460 | A2 | 11/2008 |
| WO | WO2009061124 | A2 | 5/2009 |
| WO | WO2009067074 | A1 | 5/2009 |
| WO | WO2009111978 | A1 | 9/2009 |
| WO | WO2009143047 | A2 | 11/2009 |
| WO | WO2010014437 | A2 | 2/2010 |
| WO | WO2010030509 | A2 | 3/2010 |
| WO | WO2010047896 | A3 | 4/2010 |
| WO | WO2010047898 | A3 | 4/2010 |
| WO | WO2010047973 | A3 | 4/2010 |
| WO | WO2010069983 | A1 | 6/2010 |
| WO | WO2010083370 | A2 | 7/2010 |
| WO | WO2010088105 | A3 | 8/2010 |
| WO | WO2010132625 | A2 | 11/2010 |
| WO | WO2010141537 | A2 | 12/2010 |
| WO | WO2011005562 | A2 | 1/2011 |
| WO | WO2011005579 | A2 | 1/2011 |
| WO | WO2011072308 | A1 | 6/2011 |
| WO | WO2011074884 | | 6/2011 |
| WO | WO2011113709 | A2 | 9/2011 |
| WO | WO2011117059 | A1 | 9/2011 |
| WO | WO2012001584 | A1 | 1/2012 |
| WO | WO2012004708 | A2 | 1/2012 |
| WO | WO2012007899 | A1 | 1/2012 |
| WO | WO2012025626 | A1 | 3/2012 |
| WO | WO2012063174 | A1 | 5/2012 |
| WO | WO2012117018 | A1 | 9/2012 |
| WO | WO2012129301 | A1 | 9/2012 |
| WO | WO2012131522 | A1 | 10/2012 |
| WO | WO2012131547 | A1 | 10/2012 |
| WO | WO2013028965 | A2 | 2/2013 |
| WO | WO2013029960 | A1 | 3/2013 |
| WO | WO2013030128 | A2 | 3/2013 |
| WO | WO2013045255 | A1 | 4/2013 |
| WO | WO2013045439 | A1 | 4/2013 |
| WO | WO2013057660 | A2 | 4/2013 |
| WO | WO2013079242 | A1 | 6/2013 |
| WO | WO2013088299 | A1 | 6/2013 |
| WO | 2013/097823 | A1 | 7/2013 |
| WO | 2013/098700 | A1 | 7/2013 |

OTHER PUBLICATIONS

International Search Report and Written Opinion dated Feb. 9, 2012 from the corresponding International Application No. PCT/US2011/043524 filed on Jul. 11, 2011.

Airport International. Fly High With Intelligent Airport Building and Security Solutions [online], [retrieved on Oct. 24, 2008]. Retrieved from Airport International web page using Internet <URL: http://www.airport-int.com/categories/airport-building-and-security-solutions/fly-high-with-intelligent-airport-building-and-security-solutions.html>.

Cornell University. Light Canopy—Cornell University Solar Decathlon, [online], [retrieved on Jan. 17, 2008] Retrieved from Cornell University web page using Internet <URL: http://cusd.cornell.edu/cusd/web/index.php/page/show/section/Design/page/controls>.

D.N.A.-III, [online], [retrieved Mar. 10, 2009] Retrieved from the PLC Lighting Web Page using Internet <URL: http://www.plclighting.com/product_info.php?cPath=1&products_id=92>.

E20112-22 Starburst Collection, [online], [retrieved on Jul. 10, 2010] Retrieved from ET2 Contemporary Lighting using Internet <URL: http://www.et2online.com/proddetail.aspx?ItemID=E20112-22>.

E20116-18 Larmes Collection, [online], [retrieved on Jul. 10, 2010] Retrieved from ET2 Contemporary Lighting using Internet <URL: http://www.et2online.com/proddetail.aspx?ItemID=E20116-18>.

(56) References Cited

OTHER PUBLICATIONS

E20524-10 & E20525-10 Curva Collection, [online], [retrieved on Jul. 10, 2010] Retrieved from ET2 Contemporary Lighting using Internet <URL: http://www.et2online.com/proddetail.aspx?ItemID=E20524-10 & E20525-10>.
E20743-09 Stealth Collection, [online], [retrieved on Jul. 10, 2010] Retrieved from ET2 Contemporary Lighting using Internet <URL: http://www.et2online.com/proddetail.aspx?ItemID=E20743-09>.
E22201-44 Esprit Collection, [online], [retrieved on Jul. 10, 2010] Retrieved from ET2 Contemporary Lighting using Internet <URL: http://www.et2online.com/proddetail.aspx?ItemID=E22201-44>.
Experiment Electronic Ballast. Electronic Ballast for Fluorescent Lamps [online], Revised Fall of 2007. [Retrieved on Sep. 1, 1997]. Retrieved from Virginia Tech Web Page using Internet <URL: http://www.ece.vt.edu/ece3354/labs/ballast.pdf.>.
Henson, Keith. The Benefits of Building Systems Integration, Access Control & Security Systems Integration, Oct. 1, 2000, Penton Media. [online], [retrieved on Oct. 24, 2008] Retrieved from Security Solutions Web page using Internet <URL: http://securitysolutions.com/mag/security_benefits_building_systems/>.
Hightower et al, "A Survey and Taxonomy of Location Systems for Ubiquitous Computing", University of Washington, Computer Science and Engineering, Technical Report UW-CSE 01-08-03, IEEE, Aug. 24, 2001 in 29 pages.
Lawrence Berkeley National Labratory. Lighting Control System—Phase Cut Carrier. University of California, [online] [retrieved on Jan. 14, 2008] Retrieved from Lawrence Berkeley National Labratory web page using Internet <URL: http://www.lbl.gov/tt/techs/lbnl1871.html>.
LCD Optics 101 Tutorial [online]. 3M Corporation, [retrieved on Jan. 6, 2010]. Retrieved from the internet: <URL: http://solutions.3m.com/wps/portal/3M/en_US/Vikuiti1/BrandProducts/secondary/optics101/>.
LED Lights, Replacement LED lamps for any incandescent light, [online], [retrieved on Jan. 13, 2000] Retrieved from LED Lights Web Page using Internet <URL: http://www.ledlights.com/replac.htm>.
LEDtronics, LEDtronics Catalog, 1996, p. 10, LEDtronics, Torrance, California.
Phason Electronic Control Systems, Light Level Controller (LLC) case study. Nov. 30, 2004. 3 pages, Phason Inc., Winnipeg, Manitoba, Canada.
Philips. Sense and Simplicity—Licensing program for LED Luminaires and Retrofits, Philips Intellectual Property & Standards, May 5, 2009.
Piper. The Best Path to Efficiency. Building Operating Management, Trade Press Publishing Company May 2000 [online], [retrieved on Jan. 17, 2008]. Retrieved from Find Articles Web Page using Internet <URL:http://findarticles.com/p/articles/mi_qu3922/is_200005/ai_n8899499/>.
PLC-81756-AL "Fireball" Contemporary Pendant Light, [online], [retrieved on Feb. 27, 2009] Retrieved from the Arcadian Lighting Web Page using Internet <URL: http://www.arcadianlighting. com/plc-81756-al.html>.
PLC-96973-PC PLC Lighting Elegance Modern/Contemporary Pendant Light, [online], [retrieved on Feb. 27, 2009] Retrieved from the Arcadian Lighting Web Page using Internet <URL: http/www.arcadianlighting.com/plc-96978-pc.html>.
Saha et al, "Location Determination of a Mobile Device using IEEE 802.11 Access Point Signals", May 5, 2002 in 20 pages.
Sensor Switch, nLight Lighting Control System, [online], [retrieved on Jan. 11, 2008] Retrieved from Sensor Switch web page using Internet <URL: http://www.sensorswitch.com>.
Six Strategies, [online], [retrieved on Jan. 11, 2008] Retrieved from Encelium Technologies Inc. Web Page using Internet <URL: http://www.encelium.com/products/strategies.html>.
Spencer, Eugene. High Sales, Low Utilization. Green Intelligent Buildings, Feb. 1, 2007. [online]. Retrieved from Green Intelligent Buildings web page using Internet <URL: http://www.greenintelligentbuildings.com/CDA/IBT_Archive/BNP_GUID_9-5-2006_A_10000000000000056772>.
Telecite Products & Services—Display Options, [online], [retrieved on Jan. 13, 2000] Retrieved from Telecite Web page using Internet <URL: http://www.telecite.com/en/products/options en.htm>.
Traffic Signal Products—Transportation Products Group, [online], [retrieved on Jan. 13, 2000] Retrieved from the Dialight Web Page using Internet <URL: http://www.dialight.com/trans.htm>.
Truck-Lite, LEDSelect—LED, Model 35, Clearance & Marker Lighting, [online], [retrieved on Jan. 13, 2000] Retrieved from Truck-Lite Web Page using Internet <URL: http://trucklite.com/leds14.html>.
Truck-Lite, LEDSelect—LED, Model 45, Stop, Turn & Tail Lighting [online], [retrieved on Jan. 13, 2000] Retrieved from Truck-Lite Web Page using Internet <URL: http://trucklite.com/leds4.html>.
Truck-Lite, LEDSelect—LED, Super 44, Stop, Turn & Tail Lighting, [online], [retrieved on Jan. 13, 2000] Retrieved from Truck-Lite Web Page using Internet <URL: http://trucklite.com/leds2.html>.
Wolsey, Robert. Interoperable Systems: The Future of Lighting Control, Lighting Research Center, Jan. 1, 1997, vol. 2 No. 2, Rensselaer Polytechnic Institute, Troy, New York [online]. Retrieved Lighting Research Center Web Page using Internet <URL: http://www.lrc.rpi.edu/programs/Futures/LF-BAS/index.asp>.
International Search Report and Written Opinion dated Feb. 15, 2013 from the corresponding International Application No. PCT/US2012/052244 filed on Aug. 24, 2012.
International Search Report and Written Opinion dated Aug. 30, 2011 for the corresponding International Application No. PCT/US2011/029994 filed Mar. 25, 2011.
Notification of Transmittal, the International Search Report and the Written Opinion of the International Searching Authority dated May 7, 2012, from the corresponding International Application No. PCT/US2011/064151.
Supplementary European Search Report for corresponding European Application No. 09822381.1 mailed Jan. 4, 2013 in 5 pages.
Supplementary European Search Report dated Feb. 22, 2012 from European Patent Application No. 09822424.9.
International Report on Patentability dated May 24, 2010 from the corresponding International Application No. PCT/US2009/060087 filed Oct. 9, 2009.
Extended European Search Report for co-pending European Application No. 10 73 2124 mailed on Dec. 13, 2012 in 8 pages.
Extended European Search Report for co-pending European Application No. 09822425.6 mailed on Aug. 30, 2012 in 9 pages.
Extended European Search Report for co-pending European Application No. 10797596.3 mailed on Jan. 17, 2013 in 11pages.
Extended European Search Report for co-pending European Application No. 10736237.8 mailed on Oct. 19, 2012 in 5 pages.
Extended European Search Report for co-pending European Application No. 10738925.6 mailed on Oct. 1, 2012 in 7 pages.
Examination and Search Report mailed on Jul. 2, 2012 in cooresponding United Kingdom Application No. 1018896.9 in 4 pages.
International Search Report and Written Opinion dated Jan. 4, 2010 from the corresponding International Application No. PCT/US2009/044313 filed May 18, 2009.
International Search Report and Written Opinion dated Feb. 7, 2011 from the corresponding International Application No. PCT/US2010/039678 filed Jun. 23, 2010.
International Search Report and Written Opinion dated May 7, 2010 from the corresponding International Application No. PCT/US2009/057109 filed on Sep. 16, 2009.
International Search Report and Written Opinion dated Apr. 8, 2010 from the corresponding International Application No. PCT/2009/055114 filed on Aug. 27, 2009.
International Search Report and Written Opinion dated Feb. 8, 2011 from the corresponding International Application No. PCT/US2010/039608 filed Jun. 23, 2010.
International Search Report and Written Opinion dated Dec. 13, 2010 from the corresponding International Application No. PCT/US2010/037006 filed Jun. 2, 2010.
International Search Report and Written Opinion dated Mar. 13, 2012 from the corresponding International Application No. PCT/US2011/052995 filed on Sep. 23, 2011.

(56) References Cited

OTHER PUBLICATIONS

International Search Report and Written Opinion dated May 14, 2010 from the corresponding International Application No. PCT/US2009/060085 filed Oct. 9, 2009.
International Search Report and Written Opinion dated Aug. 16, 2010 from the corresponding International Application No. PCT/US2010/021131 filed on Jan. 15, 2010.
International Search Report and Written Opinion dated Jul. 16, 2009 from the corresponding International Application No. PCT/US2008/084650 filed Nov. 25, 2008.
International Search Report and Written Opinion dated Aug. 17, 2010 from the corresponding International Application No. PCT/US2010/021489 filed on Jan. 20, 2010.
International Search Report and Written Opinion dated Jul. 17, 2009 from the corresponding International Application No. PCT/US2008/085118 filed Dec. 1, 2008.
International Search Report and Written Opinion dated Nov. 21, 2011 from the corresponding International Application No. PCT/US2011/029932 filed on Mar. 25, 2011.
International Search Report and Written Opinion dated Mar. 22, 2010 from the corresponding International Application No. PCT/US2009/053853 filed Aug. 14, 2009.
International Search Report and Written Opinion dated Nov. 23, 2011 from the corresponding International Application No. PCT/US2011/042761 filed on Jul. 1, 2011.
International Search Report and Written Opinion dated Nov. 23, 2011 from the corresponding International Application No. PCT/US2011/042775 filed on Jul. 1, 2011.
International Search Report and Written Opinion dated Dec. 24, 2010 from the corresponding International Application No. PCT/US2010/034635 filed May 13, 2010.
International Search Report and Written Opinion dated May 24, 2010 from the corresponding International Application No. PCT/2009/060083 filed Oct. 9, 2009.
Notification of Transmittal, the International Search Report and the Written Opinion of the International Searching Authority dated May 7, 2012 from the corresponding International Application No. PCT/US2011/058312.
International Search Report and Written Opinion dated Aug. 25, 2009 from corresponding International Application No. PCT/US2009/031049 filed Jan. 15, 2009.
International Search Report and Written Opinion dated Jan. 25, 2010 from the corresponding International Application No. PCT/US2009/048623 filed Jun. 25, 2009.
International Search Report and Written Opinion dated Feb. 26, 2010 from the corresponding International Application No. PCT/US2009/050949 filed Jul. 17, 2009.
International Search Report and Written Opinion dated Apr. 30, 2010 from the corresponding International Application No. PCT/US2009/057072 filed on Sep. 16, 2009.
International Search Report and Written Opinion dated Jul. 30, 2010 from the corresponding International Application No. PCT/US2010/021448 filed on Jan. 20, 2010.
International Search Report and Written Opinion dated Sep. 30, 2011 from the corresponding International Application No. PCT/US2011/029905 filed on Mar. 25, 2011.
International Search Report and Written Opinion dated Aug. 13, 2013 for the corresponding International Application No. PCT/US2013/028669 filed Mar. 1, 2013.

* cited by examiner

ELECTRICAL CONNECTOR HEADER FOR AN LED-BASED LIGHT

CROSS-REFERENCE TO RELATED APPLICATION

This application is a claims priority from U.S. Provisional Application Ser. No. 61/605,987 filed Mar. 2, 2012, which is hereby incorporated by reference in its entirety.

TECHNICAL FIELD

The embodiments disclosed herein relate in general to a light emitting diode (LED)-based light for replacing a conventional light in a standard light fixture, and in particular to components and processes for making electrical connections between electrical assemblies in an LED-based light.

BACKGROUND

Fluorescent lights are widely used in a variety of locations, such as schools and office buildings. Although conventional fluorescent lights have certain advantages over, for example, incandescent lights, they also pose certain disadvantages including, inter alia, disposal problems due to the presence of toxic materials within the light.

LED-based lights designed as one-for-one replacements for fluorescent lights have appeared in recent years. These LED-based lights can include a number of electrical assemblies, such as electrical connectors and various circuit boards. Electrical connections are often required between the electrical assemblies in order to permit conveyance of power between them. During manufacture of an LED-based light, these electrical connections may be made by landing wires between the electrical assemblies. However, wires are typically flexible and may be hard to grasp. Further, undesirable memory may be generated within a wire due to spooling, which causes inconsistencies in the curvature of a given length of wire. These properties, for example, can make it difficult to position and maintain typical wires in a desired orientation and spacing with respect to the electrical assemblies while making the electrical connections.

Manufacturers of LED-based lights, and in particular manufactures wanting to automate the assembly of LED-based lights, may therefore desire improvements upon the components and processes typically used for making electrical connections between the electrical assemblies.

SUMMARY

Disclosed herein are embodiments of LED-based lights including connector headers and method for assembling components of LED-based lights using connector headers.

In one aspect, an LED-based light configured for replacing a conventional fluorescent light in a fluorescent light fixture comprises: an LED circuit board including at least one LED; a power supply circuit board configured to supply power to the at least one LED; an end cap carrying at least one pin configured for connection to the fixture; a pin connector header, the pin connector header including a first body retentively supporting at least one pin connecting lead and configured to engage the power supply circuit board such that the pin connecting lead is positioned to electrically connect the power supply circuit board and the pin; and a circuit connector header, the circuit connector header including a second body retentively supporting at least one circuit connecting lead and configured to engage the power supply circuit board such that the circuit connecting lead is positioned to electrically connect the power supply circuit board and the LED circuit board.

In another aspect, an LED-based light configured for replacing a conventional fluorescent light in a fluorescent light fixture comprises: an LED circuit board including at least one LED; a power supply circuit board configured to supply power to the at least one LED; an end cap carrying at least one pin configured for connection to the fixture; and a connector header, the connector header including a body retentively supporting at least one lead having a first contacting portion and a second contacting portion and configured to engage the power supply circuit board such that the first contacting portion of the lead is positioned within a pad of the power supply circuit board and the second contacting portion of the lead is positioned within one of: a pad of the LED circuit board to electrically connect the power supply circuit board and the LED circuit board, and a pin cavity defined by the pin to electrically connect the power supply circuit board and the pin.

In yet another aspect, a method of assembling components of an LED-based light configured for replacing a conventional fluorescent light in a fluorescent light fixture, the components including at least an LED circuit board including at least one LED, a power supply circuit board configured to supply power to the at least one LED and an end cap carrying at least one pin configured for connection to the fixture comprises: engaging the power supply circuit board with a connector header including a body retentively supporting at least one lead and having a first contacting portion and a second contacting portion, wherein the engagement positions the first portion within a pad of the power supply circuit board and arranges the second contacting portion at a predetermined position; and positioning one of the LED circuit board and the pin based on the predetermined position of the second contacting portion.

These and other aspects will be described in additional detail below.

BRIEF DESCRIPTION OF THE DRAWINGS

The various features, advantages and other uses of the present apparatus will become more apparent by referring to the following detailed description and drawings in which.

DETAILED DESCRIPTION

Disclosed herein are embodiments of electrical connector headers that can simplify the process of making electrical connections between the electrical assemblies of an LED-based light. The electrical connector headers can be manipulated by automated equipment in order to facilitate automated assembly of LED-based lights. Although the disclosed embodiments of electrical connector headers offer particular advantages with respect to automated assembly of LED-based lights, it will be understood that the electrical connector headers may be advantageously applied in manual assembly processes as well.

Figure 1:
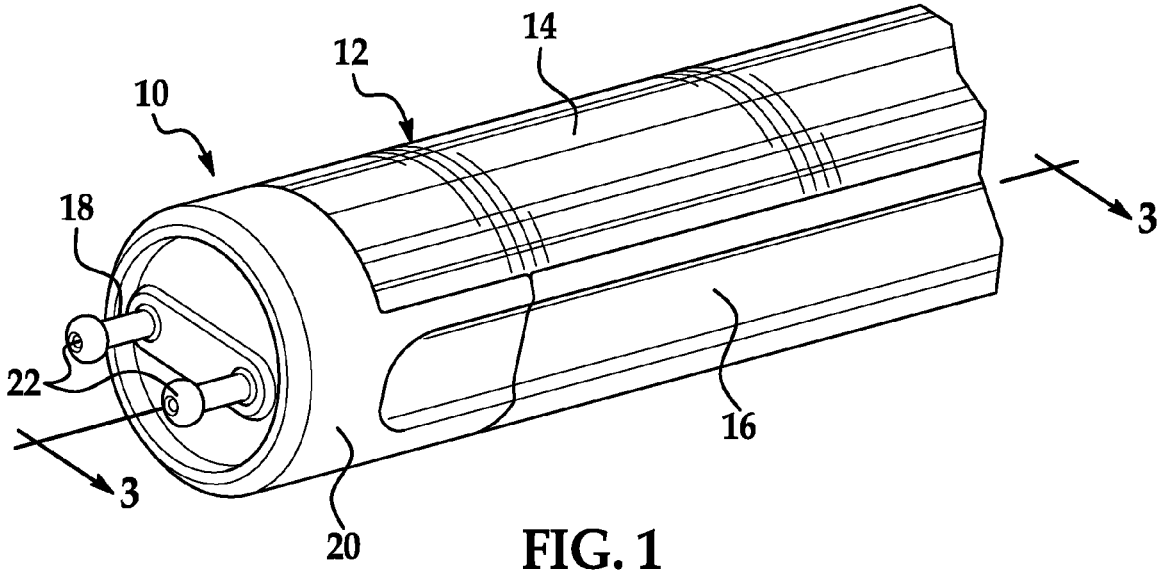
FIG. 1 is a partial perspective view of an example of an LED-based light.

FIG. 1 illustrates an LED-based light 10 for replacing a conventional light in a standard light fixture (not shown). The light fixture can be designed to accept conventional fluorescent lights, such as T5, T8 or T12 fluorescent tube lights, or can be designed to accept other standard lights, such as incandescent bulbs. The light fixture could alternatively be designed to accept non-standard lights, such as lights installed by an electrician. The fixture can connect to a power source, and can optionally include a ballast connected between the power source and LED-based light 10.

In some implementations, the LED-based light 10 includes a housing 12 at least partially defined by a high dielectric light transmitting lens 14. The lens 14 can be made from polycarbonate, acrylic, glass or other light transmitting material (i.e., the lens 14 can be transparent or translucent). The term "lens" as used herein means a light transmitting structure, and not necessarily a structure for concentrating or diverging light.

The LED-based light 10 can include features for uniformly distributing light to an environment to be illuminated in order to replicate the uniform light distribution of a conventional fluorescent light. For example, the lens 14 can be manufactured to include light diffracting structures, such as ridges, dots, bumps, dimples or other uneven surfaces formed on an interior or exterior of the lens 14. The light diffracting structures can be formed integrally with the lens 14, for example, by molding or extruding, or the structures can be formed in a separate manufacturing step such as surface roughening. In addition to or as an alternative to light diffracting structures, a light diffracting film can be applied to the exterior of the lens 14 or placed in the housing 12, or, the material from which the lens 14 is formed can include light refracting particles. For example, the lens 14 can be made from a composite, such as polycarbonate, with particles of a light refracting material interspersed in the polycarbonate. In other embodiments, the LED-based light 10 may not include any light diffracting structures or film.

The illustrated example of a housing 12 can be formed by attaching multiple individual parts, not all of which need be light transmitting. For example, the housing 12 can be formed in part by attaching the lens 14 to an opaque lower portion 16. Alternatively, the housing 12 can include a light transmitting tube at least partially defined by the lens 14. The housing 12 can additionally include other components, such as one or more highly thermally conductive structures for enhancing heat dissipation. While the illustrated housing 12 is cylindrical, a housing having a square, triangular, polygonal, or other cross sectional shape can alternatively be used. Similarly, while the illustrated housing 12 is linear, housings having an alternative shape, e.g., a U-shape or a circular shape can alternatively be used. The LED-based light 10 can have any suitable length. For example, the LED-based light 10 may be approximately 48" long, and the housing 12 can have a 0.625", 1.0" or 1.5" diameter for engagement with a common standard fluorescent light fixture.

The LED-based light 10 can include an electrical connector 18 positioned at an end of the housing 12. In the illustrated example, the electrical connector 18 is a bi-pin connector carried by an end cap 20. A pair of end caps 20 can be attached at opposing longitudinal ends of the housing 12 for physically connecting the LED-based light 10 to a standard fluorescent light fixture. The end caps 20 can be the sole physical connection between the LED-based light 10 and the fixture. At least one of the end caps 20 can additionally electrically connect the LED-based light 10 to the fixture to provide power to the LED-based light 10. Each end cap 20 can include two pins 22, although two of the total four pins can be "dummy pins" that provide physical but not electrical connection to the fixture. Bi-pin electrical connector 18 is compatible with many standard fluorescent fixtures, although other types of electrical connectors can be used, such as single pin connector or screw type connector.

Figure 2:
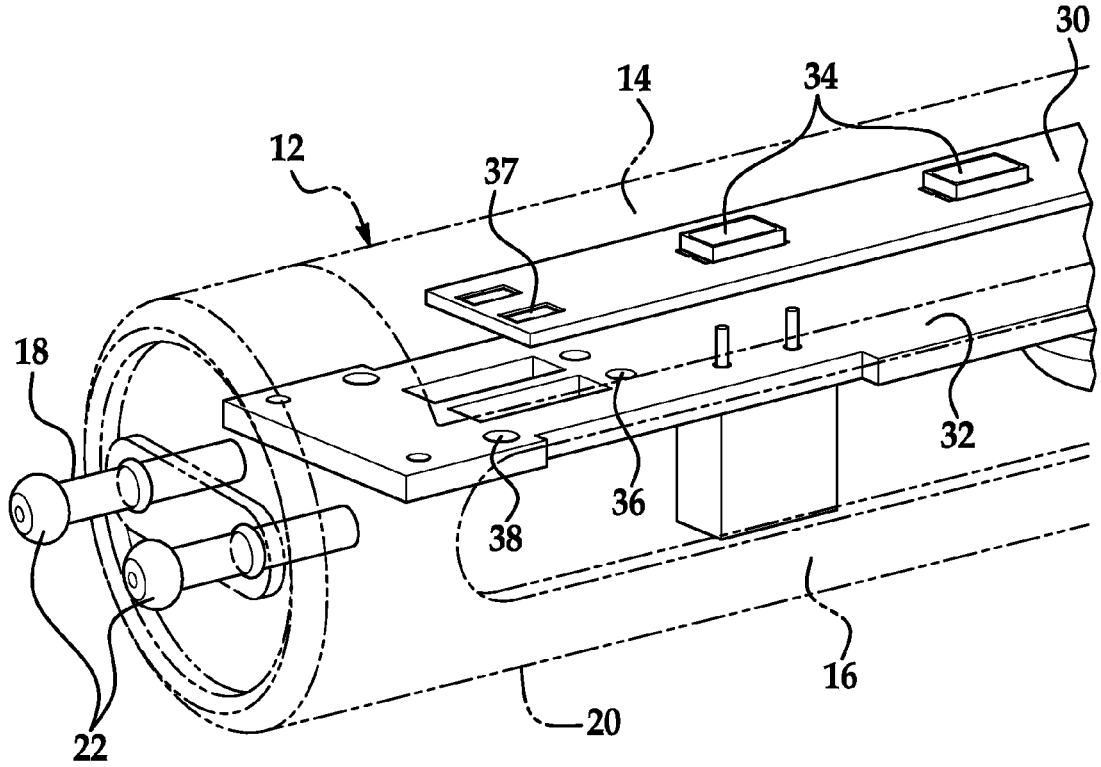
FIG. 2 is a partial perspective view of examples of electrical assemblies housed by the LED-based light of FIG. 1.

As shown with additional reference to FIG. 2, the LED-based light 10 can include a number of electrical assemblies, such as the electrical connector 18 and one or more circuit boards 30 and 32 supported within the housing 12. The circuit board 30 can be an LED circuit board having at least one LED circuit. The LED circuit board 30 can include at least one LED 34, a plurality of series-connected or parallel-connected LEDs 34, an array of LEDs 34 or any other arrangement of LEDs 34. Each of the illustrated LEDs 34 can include a single diode or multiple diodes, such as a package of diodes producing light that appears to an ordinary observer as coming from a single source. The LEDs 34 can be surface-mount devices of a type available from Nichia, although other types of LEDs can alternatively be used. For example, the LED-based light 10 can include high-brightness semiconductor LEDs, organic light emitting diodes (OLEDs), semiconductor dies that produce light in response to current, light emitting polymers, electro-luminescent strips (EL) or the like.

The LEDs 34 can emit white light. However, LEDs that emit blue light, ultra-violet light or other wavelengths of light can be used in place of or in combination with white light emitting LEDs 34. The number, spacing and orientation of the LEDs 34 can be a function of a length of the LED-based light 10, a desired lumen output of the LED-based light 10, the wattage of the LEDs 34 and/or the viewing angle of the LEDs 34. For a 48" LED-based light 10, the number of LEDs 34 may vary from about thirty to sixty such that the LED-based light 10 outputs approximately 3,000 lumens. However, a different number of LEDs 34 can alternatively be used, and the LED-based light 10 can output any other amount of lumens. The LEDs 34 can be evenly spaced along the LED circuit board 30 and arranged on the LED circuit board 30 to substantially fill a space along a length of the lens 14 between end caps 20 positioned at opposing longitudinal ends of the housing 12. Alternatively, single or multiple LEDs 34 can be located at one or both ends of the LED-based light 10. The LEDs 34 can be arranged in a single longitudinally extending row along a central portion of the LED circuit board 30, as shown in FIG. 2, or can be arranged in a plurality of rows or arranged in groups. The spacing of the LEDs 34 can be determined based on, for example, the light distribution of each LED 34 and the number of LEDs 34.

The circuit board 32 can be a power supply circuit board. The power supply circuit board 32 is positioned within the housing adjacent the electrical connector 18 and has power supply circuitry configured to condition an input power received from, for example, the fixture through the electrical connector 18, to a power usable by and suitable for the LEDs 34. In some implementations, the power supply circuit board 32 can include one or more of an inrush protection circuit, a surge suppressor circuit, a noise filter circuit, a rectifier circuit, a main filter circuit, a current regulator circuit and a shunt voltage regulator circuit. The power supply circuit board 32 can be suitably designed to receive a wide range of currents and/or voltages from a power source and convert them to a power usable by the LEDs 34.

As shown, the LED circuit board 30 and the power support circuit board 32 are vertically opposed and spaced with respect to one another within the housing 12. However, it will be understood that the LED circuit board 30 and/or the power support circuit board 32 could be alternatively arranged within the housing 12, and that the LED circuit board 30 and the power support circuit board 32 could be alternatively spaced with respect to one another. Further, although the LED circuit board 30 and the power supply circuit board 32 are shown as separate components, the power supply circuitry and the LED circuit could alternatively be included in a single circuit board.

The LED circuit board 30 and the power supply circuit board 32 are illustrated as elongate printed circuit boards that have electrical tracks at least partially defining the respective included circuits, which can be exposed by electrically conductive pads 37, and 36 and 38, respectively, as described in greater detail below. The LED circuit board 30 and the power supply circuit board 32 can extend a length or a partial length of the housing 12, and the LED circuit board 30 can have a length different from a length of the power supply circuit board 32. Multiple circuit board sections can be joined by bridge connectors to create the LED circuit board 30 and/or power supply circuit board 32. The LED circuit board 30 and the power supply circuit board 32 can be supported within the housing 12 through slidable engagement with a part of the housing 12, such as the end cap 20 and/or lower portion 16, though the circuit boards 30 and 32 can alternatively be clipped, adhered, snap- or friction-fit, screwed or otherwise connected to the housing 12. Also, other types of circuit boards may be used, such as a metal core circuit board. Or, instead of the LED circuit board 30 and the power supply circuit board 32, other types of electrical connections (e.g., wires) can be used to electrically connect the LEDs 34 to a power source.

Figure 3:
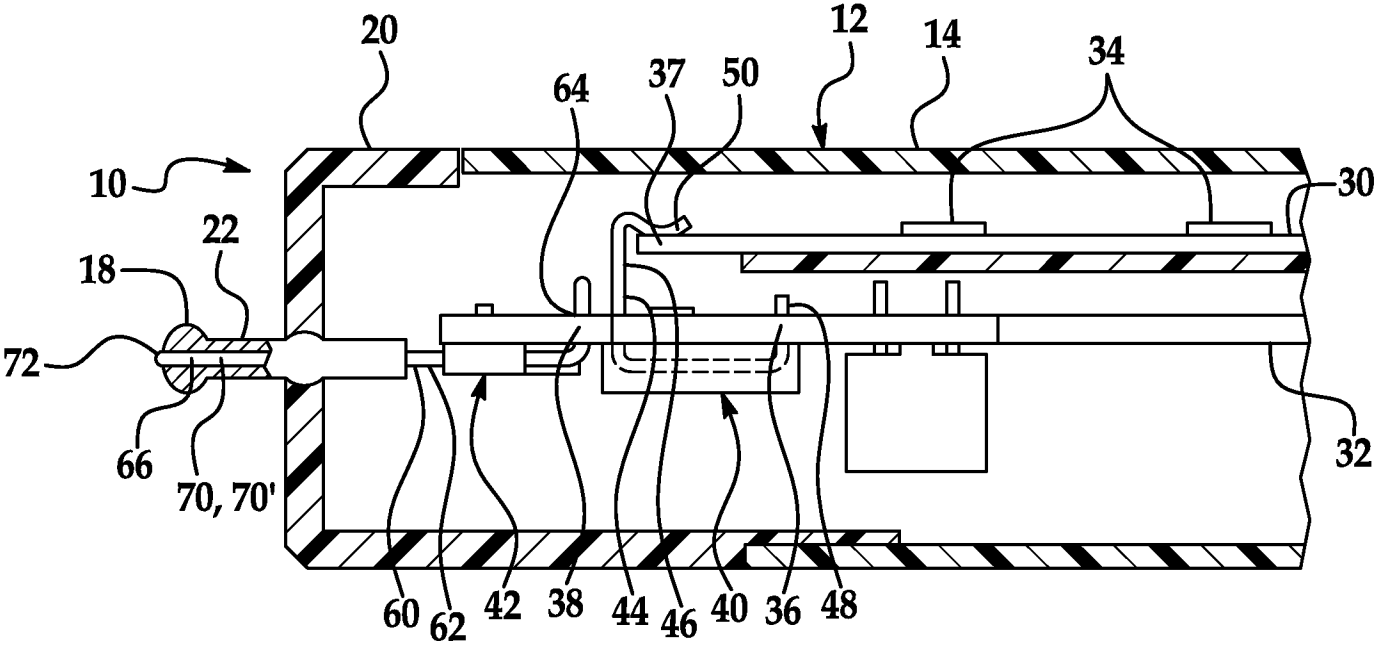
FIG. 3 is a partial cut away elevation view of the LED-based light of FIG. 1 taken along the line 3-3 and showing the electrical assemblies of FIG. 2 electrically connected by an exemplary circuit connector header and an exemplary pin connector header.

The LED-based light 10 may require a number of electrical connections to convey power between the various illustrated spatially distributed electrical assemblies that can be included in the LED-based light 10, such as the LED circuit board 30, the power supply circuit board 32 and the electrical connector 18. During assembly of the LED-based light 10, these connections can be made using a circuit connector header 40 and a pin connector header 42, as shown in FIG. 3. As shown, the circuit connector header 40 is arranged to electrically couple the LED circuit board 30 to the power supply circuit board 32, and the pin connector header 42 is arranged to electrically couple the power supply circuit board 32 to a fixture.

Figure 4:
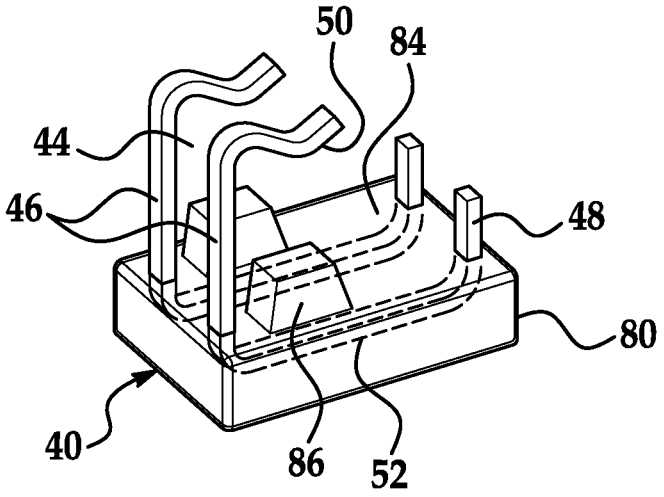
FIG. 4 is a perspective view of the exemplary circuit connector header of FIG. 3.

As shown with additional reference to FIG. 4, the circuit connector header 40 includes at least one contact element 44 configured to electrically couple the LED circuit included in the LED circuit board 30 to the power supply circuitry included in the power supply circuit board 32. The contact element 44 is illustrated as a pair of continuous electrically conductive circuit connecting leads 46, although the contact element 44 can alternatively be any number of circuit connecting leads 46, such as a single circuit connecting lead 46. The circuit connecting leads 46 may have a configuration differing from that specifically shown. For instance, the circuit connecting leads 46 could be or include one or more blade shaped components. The contact element 44 can have at least one power supply circuit board contacting portion 48 and at least one LED circuit board contacting portion 50. As shown, a pair of power supply circuit board contacting portions 48 is located at respective first terminal ends of the circuit connecting leads 46, and a pair of LED circuit board contacting portions 50 is located at respective second terminal ends of the circuit connecting leads 46 opposite the first terminal ends. In one embodiment, and as illustrated in FIG. 4, the power supply circuit board contacting portion 48 and the LED circuit board contacting portion 50 can be in electrically conductive communication through an intermediate portion 52 formed continuously with the first and second terminal ends of the lead 46.

Each power supply circuit board contacting portion 48 can be positioned within the housing 12 to electrically connect to a part of the power supply circuit, for example a conditioned power output pad 36 included in the power supply circuit board 32. The conditioned power output pad 36 is shown as a through-hole pad defined by the power supply circuit board 32, although the conditioned power output pad 36 could alternatively be a surface mount pad, for example. The power supply circuit board contacting portion 48 can be inserted into the conditioned power output pad 36 and secured by methods known to those skilled in the art, such as soldering, so that power can be conveyed from the power supply circuitry included in the power supply circuit board 32 to the contact element 44. Similarly, each LED circuit board contacting portion 50 can be positioned within the housing 12 to contact a part of the LED circuit, for example a conditioned power receiving pad 37 included in the LED circuit board 30. The conditioned power receiving pad 37 is shown as a surface mount pad, although the conditioned power receiving pad 37 could alternatively be a through-hole pad, for example. The LED circuit board contacting portion 50 can be placed into the conditioned power receiving pad 37 and secured, for example, through a spring contact force applied by an arcuate portion of the lead 46. The spring contact force can urge the LED circuit board contacting portion 50 into an electrically conductive relation with the conditioned power receiving pad 37. The LED circuit board contacting portion 50 can additionally or alternatively be secured by other methods known to those skilled in the art, such as soldering. Once secured, power can be conveyed from the contact element 44 to the LED circuit included in the LED circuit board 32. With both the power supply circuit board contacting portion 48 and the LED circuit board contacting portion 50 secured, the power supply circuit and the LED circuit are electrically coupled through the contact element 44, such that a power usable by the LEDs 34 can be supplied from the power supply circuitry to the LED circuit.

Figure 5:
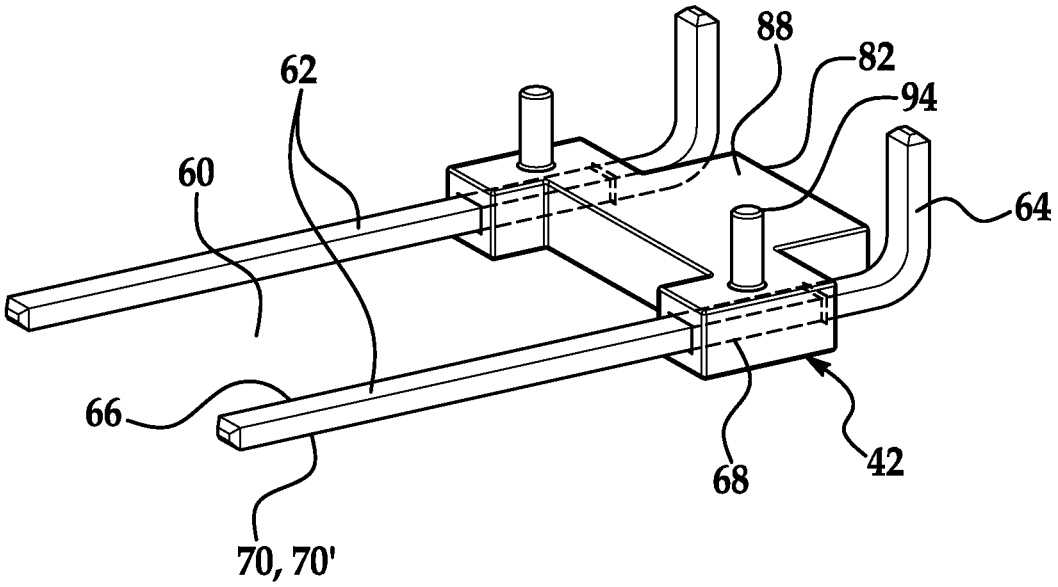
FIG. 5 is a perspective view of the exemplary pin connector header of FIG. 3.

As shown in FIGS. 3 and 5, the pin connector header 42 includes at least one contact element 60 configured to electrically couple the power supply circuitry included in the power supply circuit board 32 to a fixture. The contact element 60 is illustrated as a pair of continuous electrically conductive pin connecting leads 62, although the contact element 60 can alternatively be any number of pin connecting leads 62, such as a single lead 62. The pin connecting leads 62 may have a configuration differing from that specifically shown. For instance, the pin connecting leads 62 could be or include one or more blade shaped components and/or could include one or more portions shaped for compatibility with a standard light fixture, as explained below. The contact element 60 can have at least one power supply circuit board contacting portion 64 and at least one input power conducting portion 66. As shown, a pair of power supply circuit board contacting portions 64 is located at respective first terminal ends of the pin connecting leads 62, and a pair of input power conducting portions 66 is located at respective second terminal ends of the pin connecting leads 62 opposite the first terminal ends. In one embodiment, and as illustrated in FIG. 5, the power supply circuit board contacting portion 64 and input power conducting portion 66 can be in electrically conductive communication through an intermediate portion 68 formed continuously with the first and second terminal ends of the lead 62.

Each power supply circuit board contacting portion 64 can be positioned within the housing 12 to electrically connect to a part of the power supply circuit, for example a input power receiving pad 38 included in the power supply circuit board 32. The input power receiving pad 38 is shown as a through-hole pad defined by the power supply circuit board 32, although the input power receiving pad 38 could alternatively be a surface mount pad, for example. The power supply circuit board contacting portion 64 can be inserted into the input power receiving pad 38 and secured by methods known to those skilled in the art, such as soldering, so that power can be conveyed from the power supply circuitry included in the power supply circuit board 32 to the contact element 60.

The input power conducting portions 66 can have a pin contacting portion 70 configured for electrical connection with an electrical connector 18, such as the illustrated bi-pin connector having a pair of pins 22. The pin contacting portion 70 can be positioned within the housing 12 in electrically conductive contact with one or both of the pins 22. The pin contacting portion 70 and a pin 22 can have respective complementary surfaces configured for electrical conduction when placed into contact with one another. As illustrated, a pin 22 can define a cavity, and the pin contacting portion 70 can be axially aligned with the pin cavity 72 and positioned for insertion into the pin cavity 72 as the pin 22 carrying end cap 20 is assembled into the housing 12. The pin contacting portion 70 can additionally and/or alternatively be secured within the pin cavity 72 by methods known to those skilled in the art, such as soldering. Other configurations of a pin contacting portion 70 and a pin 22 can also be used. For example, a cavity could be defined by the pin contacting portion 70, with a part of the pin 22 configured for insertion into the cavity. Alternatively, a spring force could hold the pin contacting portion 70 in electrically conductive contact with the pin 22, and/or the pin contacting portion 70 could be soldered to the pin 22.

In an alternative aspect of an input power conducting portion 66, the input power conducting portion 70 can include a fixture contacting portion 70' configured for direct physical and electrical connection to a standard fluorescent light fixture. In this aspect, the fixture contacting portion 70' can fully or partially form the electrical connector 18, for example by forming one or more electrically conductive pins 22.

Once secured, power can be conveyed from a fixture to the input power conducting portion 66. With both the power supply circuit board contacting portion 64 and the input power conducting portion 66 secured, the fixture and the power supply circuitry are electrically coupled through the contact element 60, such that an input power can be supplied to the power supply circuitry. The power supply circuitry and the LED circuit can be electrically coupled through the contact element 44, such that a power usable by the LEDs 34 can be supplied to the LED circuit and the included LEDs 34 from the power supply circuitry. Alternatively, the LED circuit could be included with and electrically coupled to the power supply circuitry in a single circuit board.

As explained below, the electrical connector headers 40 and 42 can further include optional features generally useful for controlling the alignment, positioning and orientation of the respective contact elements 44 and 60 in relation to the illustrated electrical assemblies of the LED-based light 10. It will be understood that these and other disclosed features offer advantages with respect to automated assembly of the LED-based light 10. In particular, the features of the of the electrical connector headers 40 and 42 allow for automation equipment to present the respective contact elements 44 and 60 to the electrical assemblies of the LED-based light 10 (e.g., the electrical connector 18, the LED circuit board 30 and the power supply circuit board 32 in the illustrated example) in a predictable and consistent manner for installation.

As illustrated in FIG. 4, the circuit connector header 40 can include a body 80 retentively supporting the first and second terminal ends of the contact element 44, illustrated as the pair of circuit connecting leads 46, in respective predetermined positions. As shown with additional reference to FIG. 6, the body 80 can be composed of an electrically insulative material, such as a plastic material. The body 80 may, for example, be injection molded over the intermediate portions 52 of the circuit connecting leads 46, with the power supply circuit board contacting portion 48 and the LED circuit board contacting portion 50 each projecting from the body 80. The body 80 can have a flat surface 84, and the power supply circuit board contacting portion 48, illustrated at a first terminal end of the lead 46, can project normally from the surface 84 and be configured for engagement with the through-hole conditioned power output pad 36 of the power supply circuit board 32. Similarly, LED circuit board contacting portion 50, illustrated at a second terminal end of the lead 46, can project normally from the surface 84 and be configured for engagement with the surface mount conditioned power receiving pad 37 of the LED circuit board 30. Optionally, the body 80 may include projections 86 extending normally from the surface 84 and configured for insertion into respective slot apertures 90 defined by the power supply circuit board 32 to restrict lateral movement of the circuit connector header 40. As shown, the surface 84 of the body 80 can be substantially flat and configured for abutting engagement with a portion of the power supply circuit board 32, for instance, a portion of the power supply circuit board bordering the through-hole conditioned power output pad 36 and/or the slot apertures 90.

In addition, the illustrated circuit connecting leads 46 of the circuit connector header 40 can be composed of a material configured to substantially maintain its shape during assembly of the circuit connector header 40 into the LED-based light 10. For example, the circuit connecting leads 46 can be composed of a material that is firm relative to an ordinary wire, such as a rigid, stiff or resilient material. Alternatively, only a portion of the circuit connecting leads 46 could be composed of a rigid, stiff or resilient material, for example, all or some of the portions of the circuit connecting leads 46 projecting from the body 80.

Figure 6:
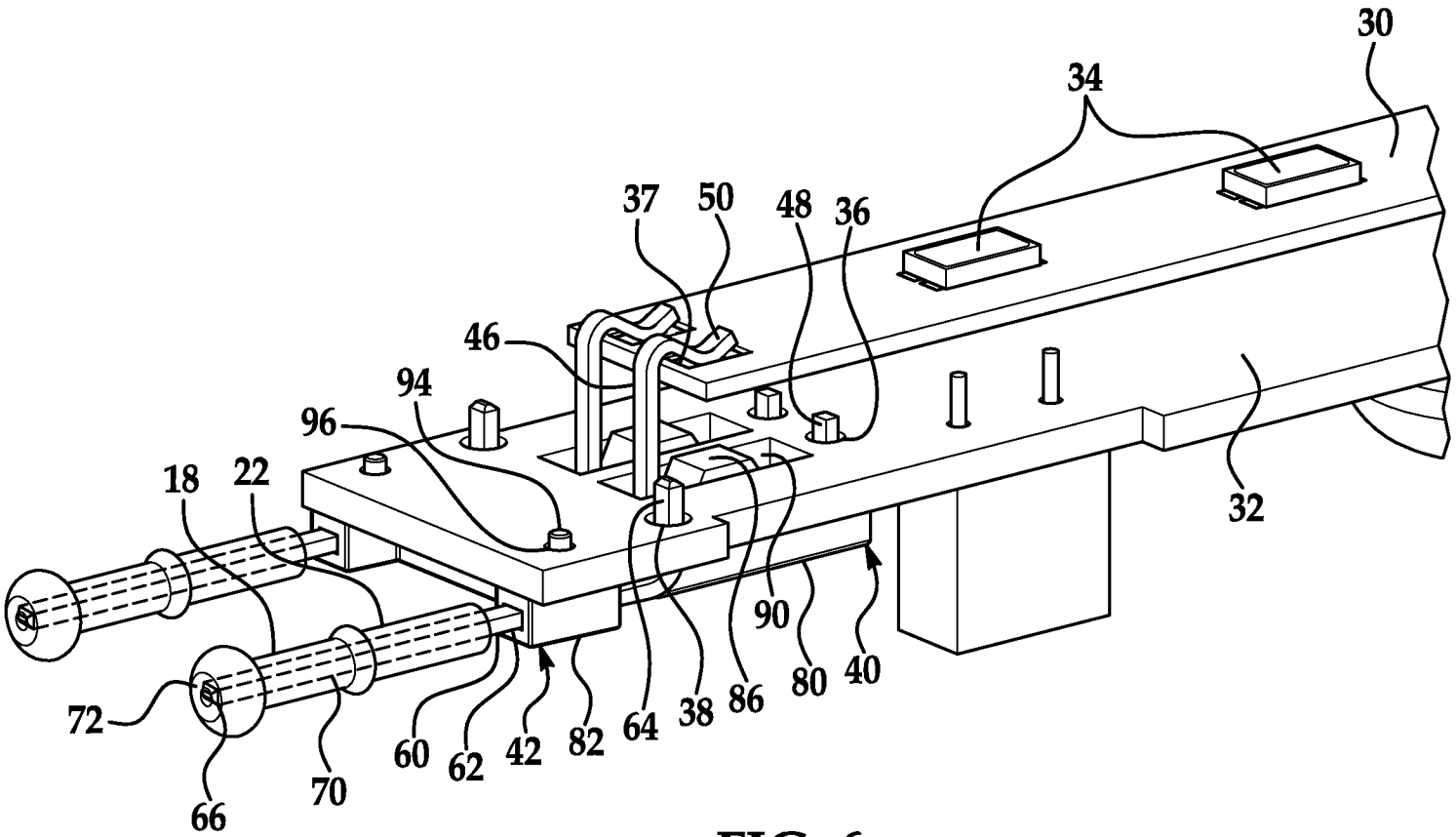
FIG. 6 is a partial perspective view showing further details of the electrical connections between the electrical assemblies of FIG. 2 by the exemplary circuit connector header of FIG. 4 and the exemplary pin connector header of FIG. 5.

Referring now to FIG. 5, the pin connector header 42 can similarly include a body 82 retentively supporting the first and second ends of the contact element 60, illustrated as the pair of pin connecting leads 62, in predetermined positions. As shown in FIGS. 5 and 6, the body 82 can be composed of an electrically insulative material, such as a plastic material. The body 82 may, for example, be injection molded over the intermediate portions 68 of the pin connecting leads 62, with the power supply circuit board contacting portion 64 and the input power conducting portions 66 each projecting from the body 82. The power supply circuit board contacting portion 64, illustrated at a first terminal end of the lead 62, can project from the body 82 and be configured for engagement with the through-hole input power receiving pad 38 of the power supply circuit board 32. The body 82 can have a flat surface 88, and one or more post like projections 94 can project normally from the surface 88 and be configured for engagement with one or more corresponding apertures 96 defined by the power supply circuit board 32. The surface 88 of the body 82 can be substantially flat and configured for abutting engagement with a portion of the power supply circuit board 32, for instance, a portion of the power supply circuit board 32 bordering the through-hole input power receiving pad 38 and/or the apertures 96.

In addition, the illustrated pin connecting leads 62 of the pin connector header 42 can be composed of a material configured to substantially maintain its shape during assembly of the circuit connector header 42 into the LED-based light 10. For example, the pin connecting leads 62 can be composed of a material that is firm relative to an ordinary wire, such as a rigid, stiff or resilient material. Alternatively, only a portion of the pin connecting leads 62 could be composed of a rigid, stiff or resilient material, for example, all or some of the portions of the pin connecting leads 62 projecting from the body 88.

Figure 7:
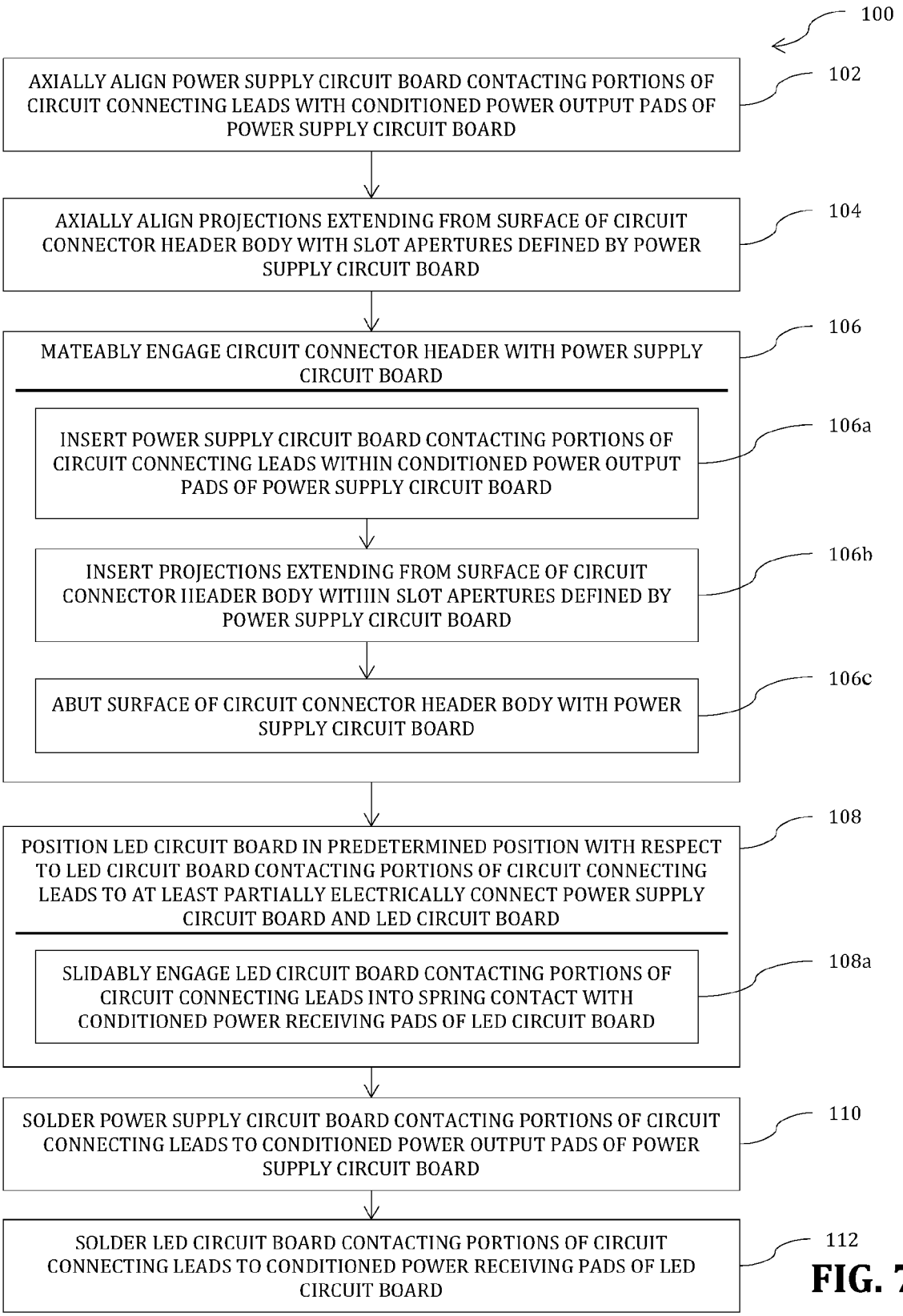
FIGS. 7 and 8 are flowcharts depicting operations for making electrical connections between the electrical assemblies of FIG. 2 using the exemplary circuit connector header of FIG. 4 the exemplary pin connector header of FIG. 5, respectively.

A process 100 for installing the circuit connector header 40 to electrically connect the power supply circuit board 32 and the LED circuit board 30 is shown in FIG. 7.

In operation 102, the power supply circuit board contacting portions 48 of the circuit connecting leads 46 are axially aligned with the conditioned power output pads 36 of the power supply circuit board 32. In operation 104, the projections 86 extending from the surface 84 of the body 80 of the circuit connector header 40 are axially aligned with the slot apertures 90 defined by the power supply circuit board 32.

In operation 106, the circuit connector header 40 is mateably engaged with the power supply circuit board 32 according to operations 106*a-c*. In operation 106*a*, the power supply circuit board contacting portions 48 of the circuit connecting leads 46 are inserted within the conditioned power output pads 36, and in operation 106*b*, the projections 86 extending from the surface 84 of the body 80 are inserted within the slot apertures 90. Operations 106*a* and 106*b* are performed until the surface 84 of the body 80 of the circuit connector header 40 abuts a surface of the power supply circuit board 32 in operation 106*c*.

It can be seen that the mateable engagement positions the power supply circuit board contacting portions 48 of the circuit connecting leads 46 within the conditioned power output pads 36, and effectively fixes the LED circuit board contacting portions 50 of circuit connecting leads 46 in a known position with respect to the power supply circuit board 32. It will be understood that, depending on the configuration of the circuit connector header 40, the operations 106*a* and 106*b* may be redundant in relation to fixing the position of the LED circuit board contacting portions 50 with respect to the power supply circuit board 32 by mateably engaging the circuit connector header 40 with the power supply circuit board 32, and that, optionally, one of the operations 106*a* or 106*b* could be eliminated.

Based on the fixed position of the LED circuit board contacting portions 50 of the circuit connecting leads 46 with respect to the power supply circuit board 32, as shown in operation 108, it is possible to position the LED circuit board 30 in a predetermined position with respect to the LED circuit board contacting portions 50 to at least partially electrically connect the power supply circuit board 32 and the LED circuit board 30.

In particular, according to operation 108*a*, the LED circuit board contacting portions 50 of the circuit connecting leads 46 may be slidably engaged into spring contact with the conditioned power receiving pads 37 of the LED circuit board 30. For instance, in the illustrated example of the circuit connector header 40, the LED circuit board contacting portions 50 are arcuate and configured for cam action with respect to a leading edge of the LED circuit board 30, such that forcible engagement of the LED circuit board 30 causes displacement of the LED circuit board contacting portions 50 that permits placement of the LED circuit board contacting portions 50 into the surface mounted conditioned power receiving pads 37 of the LED circuit board 30. Return displacement of the LED circuit board contacting portions 50 following placement of the LED circuit board contacting portions 50 into the conditioned power receiving pads 37 in turn creates spring contact between the LED circuit board contacting portions 50 into the conditioned power receiving pads 37. It will be understood that the LED circuit board contacting portions 50 of the circuit connecting leads 46 and/or the conditioned power receiving pads 37 of the LED circuit board 30 may be otherwise sized and shaped with suitable complementary configurations in furtherance of creating an electrical connection between the power supply circuit board 32 and LED circuit board 30.

The slidable engagement between the LED circuit board contacting portions 50 of the circuit connecting leads 46 and the conditioned power receiving pads 37 of the LED circuit board 30 may be aided by the configuration of the LED-based light 10. In one non-limiting example, or instance, it is contemplated that the LED circuit board 30 may be fixed within the housing 12 at the position shown in FIG. 3 prior to or contemporaneously with operations 102 through 106, and that the power supply circuit board 32, with the circuit connector header 40 engaged, can be slid into the housing 12 to the position shown in FIG. 3 to effect the slidable engagement between the LED circuit board contacting portions 50 and the conditioned power receiving pads 37 of the LED circuit board 30.

The above described operations 102 through 108 may cause electrically conductive engagement to arise between the power supply circuit board contacting portions 48 of the circuit connecting leads 46 and the conditioned power output pads 36 of the power supply circuit board 32, and between the LED circuit board contacting portions 50 of the circuit connecting leads 46 and the conditioned power receiving pads 37 of the LED circuit board 30, sufficient for creating the electrical connection between the power supply circuit board 32 and the LED circuit board 30. In this instance, the electrical connection between the power supply circuit board 32 and LED circuit board 30 may optionally be secured according to operations 110 and 112. Alternatively, it will be understood that the operations 102 through 108 may not be sufficient for creating the electrical connection between the power supply circuit board 32 and the LED circuit board 30. In this alternative, the electrical connection partially created in operations 102 through 108 may be completed according to operations 110 and 112.

In operation 110, the power supply circuit board contacting portions 48 of the circuit connecting leads 46 are soldered to the conditioned power output pads 36 of the power supply circuit board 32. Similarly, in operation 112, the LED circuit board contacting portions 50 of the circuit connecting leads 46 are soldered to the conditioned power receiving pads 37 of the LED circuit board 30.

Figure 8:
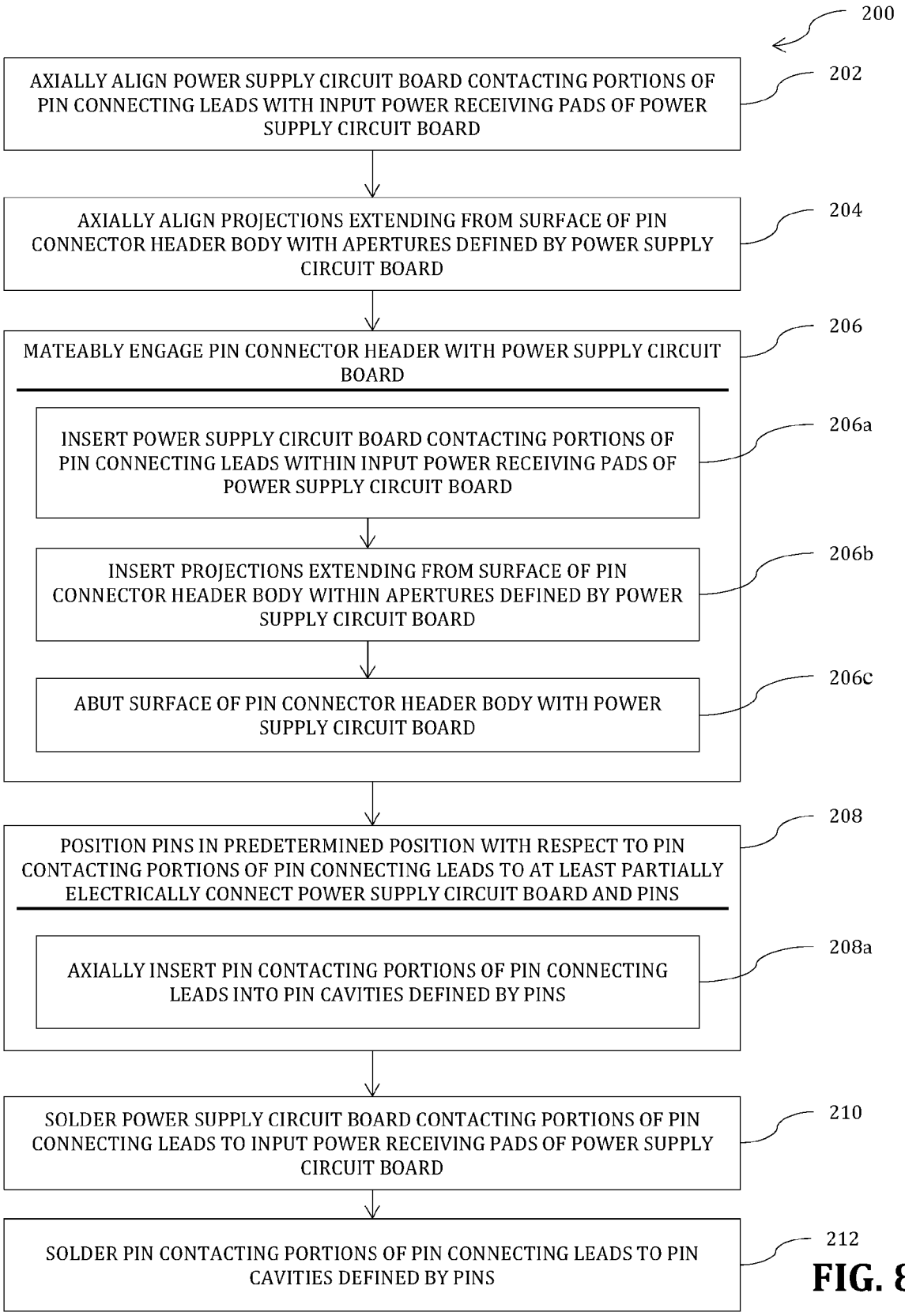

A process 200 for installing the pin connector header 42 to electrically connect the power supply circuit board 32 and the pin 22 is shown in FIG. 8.

In operation 202, the power supply circuit board contacting portions 64 of the pin connecting leads 62 are axially aligned with the input power receiving pads 38 of the power supply circuit board 32. In operation 204, the projections 94 extending from the surface 88 of the body 82 of the pin connector header 42 are axially aligned with the apertures 96 defined by the power supply circuit board 32.

In operation 206, the pin connector header 42 is mateably engaged with the power supply circuit board 32 according to operations 206*a-c*. In operation 206*a*, the power supply circuit board contacting portions 64 of the pin connecting leads 62 are inserted within the input power receiving pads 38 of the power supply circuit board 32, and in operation 206*b*, the projections 94 extending from the surface 88 of the body 82 are inserted within apertures 96. Operations 206*a* and 206*b* are performed until the surface 88 of the body 82 of the pin connector header 42 abuts a surface of the power supply circuit board 32 in operation 206*c*.

It can be seen that the mateable engagement positions the power supply circuit board contacting portions 64 of the pin connecting leads 62 within the input power receiving pads 38, and effectively fixes the pin contacting portions 70 of the pin connecting leads 62 in a known position with respect to the power supply circuit board 32. It will be understood that, depending on the configuration of the pin connector header 42, the operations 206*a* and 206*b* may be redundant in relation to fixing the position of the pin contacting portions 70 with respect to the power supply circuit board 32 by mateably engaging the pin connector header 42 with the power supply circuit board 32, and that, optionally, one of the operations 206*a* or 206*b* could be eliminated.

The mateable engagement between the pin connector header 42 and the power supply circuit board 32 can position a pin contacting portion 70' for engagement with a fixture, as explained above. However, in the illustrated example, based on the fixed position of the pin contacting portions 70 of the pin connecting leads 62 with respect to the power supply circuit board 32, as shown in operation 208, it is possible to position the pins 22 in predetermined position with respect to the pin contacting portions 70 to at least partially electrically connect the power supply circuit board 32 and the pins 22.

In particular, according to operation 208*a*, the pin contacting portions 70 of the pin connecting leads 62 may be axially inserted into the pin cavities 72 defined by the pins 22. The axial insertion of the pin contacting portions 70 of the pin connecting leads 62 into the pin cavities 72 defined by the pins 22 may be aided by the configuration of the LED-based light 10. In one non-limiting example, or instance, it is contemplated that the end cap 20 carrying the pins 22 may be configured to supportively engage the power supply circuit board 32 at the position shown in FIG. 3. In this example, subsequent to operations 202 through 206, placement of the end cap 20 into supportive engagement with the power supply circuit board 32 concurrently effects the axial insertion of the pin contacting portions 70 into the pin cavities 72 defined by the pins 22.

The above described operations 202 through 208 may cause electrically conductive engagement to arise between the power supply circuit board contacting portions 64 of the pin connecting leads 62 and the input power receiving pads 38 of the power supply circuit board 32, and between the pin contacting portions 70 of the pin connecting leads 62 and the pin cavities 72 defined by the pins 22, sufficient for creating the electrical connection between the power supply circuit board 32 and the pins 22. In this instance, the electrical connection between the power supply circuit board 32 and the pins 22 may optionally be secured according to operations 210 and 212. Alternatively, it will be understood that the operations 202 through 208 may not be sufficient for creating the electrical connection between the power supply circuit board 32 and the pins 22. In this alternative, the electrical connection partially created in operations 202 through 208 may be completed according to operations 210 and 212.

In operation 210, the power supply circuit board contacting portions 64 of the pin connecting leads 62 are soldered to the input power receiving pads 38 of the power supply circuit board 32. Similarly, in operation 212, the pin contacting portions 70 of the pin connecting leads 62 are soldered to the to pin cavities 72 defined by the pins 22.

The illustrated headers 40 and/or 42 can permit electrical connections between electrical assemblies of the LED-based light 10 to be made more easily compared to landing ordinary, flexible wires between the electrical assemblies. By using the illustrated headers 40 and/or 42, the correct alignment and positioning of the contact elements 44 and 60, and in particular of the power supply circuit board contacting portion 48 and the LED circuit board contacting portion 50 of the circuit connector header 40, and of the power supply circuit board contacting portion 64 and the input power conducting portions 66 of the pin connector header 42, can be quickly achieved in a predictable and consistent manner.

In addition to eliminating the difficulty associated with landing ordinary wires to make electrical connections between the electrical assemblies of the LED-based light 10, predictable and consistent alignment and positioning can allow for automation of the process of electrically connecting the electrical assemblies. For example, with the power supply circuit board contacting portion 48 positioned within the conditioned power output pad 36, with the LED circuit board contacting portion 50 positioned in contact with the conditioned power receiving pad 37, and with the power supply circuit board contacting portion 64 positioned within the input power receiving pad 38, the respective electrical connections are at least partially completed, and can be fully completed by soldering the contacting portions to the respective pads. Alternatively, as explained above, the positioning alone could provide the necessary electrically conductive engagement for creating the electrical connections.

The LED-based lights described herein are presented as examples and are not meant to be limiting. For example, in one embodiment, an LED-based light can include the header 40 without the header 42. Conversely, in another embodiment, an LED-based light can include the header 42 without the header 40. The embodiments can be used with any lighting components known to those skilled in the art and compatible with the scope of this disclosure.

While recited characteristics and conditions of the invention have been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An LED-based light configured for replacing a conventional fluorescent light in a fluorescent light fixture, comprising:

an LED circuit board including at least one LED;

a power supply circuit board configured to supply power to the at least one LED;

an end cap carrying at least one pin configured for connection to the fixture;

a pin connector header, the pin connector header including at least one pin connecting lead composed of a substantially shape maintaining material and having a power supply circuit board contacting portion and a pin contacting portion, and a first body retentively supporting the pin connecting lead, the pin connector header configured to engage the power supply circuit board such that the power supply circuit board contacting portion and the pin contacting portion are positioned to electrically connect the power supply circuit board and the pin; and a circuit connector header, the circuit connector header including at least one circuit connecting lead composed of a substantially shape maintaining material and having a power supply circuit board contacting portion and a LED circuit board contacting portion, and a second body retentively supporting the at least one circuit connecting lead such that the power supply circuit board contacting portion and the LED circuit board contacting portion of the circuit connecting lead project from the second body, the power supply circuit board contacting portion projecting beyond a surface of the second body, wherein:

the circuit connector header is configured to engage the power supply circuit board such that the power supply circuit board contacting portion and the LED circuit board contacting portion are positioned to electrically connect the power supply circuit board and the LED circuit board, the power supply circuit board contacting portion of the circuit connecting lead is positioned within a conditioned power output pad of the power supply circuit board with the surface of the second body abutting the power supply circuit board, and the LED circuit board contacting portion is positioned within a conditioned power receiving pad of the LED circuit board.

2. The LED-based light of claim 1, wherein:

the first body retentively supports the at least one pin connecting lead such that the power supply circuit board contacting portion and the pin contacting portion of the pin connecting lead project from the first body; and with the engagement between the pin connector header and the power supply circuit board, the power supply circuit board contacting portion of the pin connecting lead is positioned within an input power receiving pad of the power supply circuit board and the pin contacting portion is inserted within a pin cavity defined by the pin.

3. The LED-based light of claim 2, wherein with the engagement between the pin connector header and the power supply circuit board, the pin contacting portion of the pin connecting lead is axially inserted within the pin cavity.

4. The LED-based light of claim 2, wherein:

the power supply circuit board contacting portion of the pin connecting lead projects from the first body to extend beyond a surface of the first body; and the engagement between the pin connector header and the power supply circuit board at least partially includes the power supply circuit board contacting portion of the pin connecting lead positioned within the input power receiving pad of the power supply circuit board and the surface of the first body abutting the power supply circuit board.

5. The LED-based light of claim 1, wherein the LED circuit board contacting portion of the circuit connecting lead is engaged in spring contact within the conditioned power receiving pad of the LED circuit board.

6. The LED-based light of claim 1, wherein:

the first body includes a projection extending beyond a surface of the first body; and the engagement between the pin connector header and the power supply circuit board at least partially includes the projection positioned within an aperture defined by the power supply circuit board and the surface of the body abutting the power supply circuit board.

7. The LED-based light of claim 1, wherein:

the second body includes a projection extending beyond a surface of the second body; and the engagement between the circuit connector header and the power supply circuit board at least partially includes the projection positioned within an aperture defined by the power supply circuit board and the surface of the body abutting the power supply circuit board.

8. The LED-based light of claim 1, further comprising:

a housing, wherein the LED circuit board, the power supply circuit board and the pin are spatially distributed with respect to one another within the housing.

9. An LED-based light configured for replacing a conventional fluorescent light in a fluorescent light fixture, comprising:

an LED circuit board including at least one LED;

a power supply circuit board configured to supply power to the at least one LED;

an end cap carrying at least one pin configured for connection to the fixture; and a connector header, the connector header including at least one lead composed of a substantially shape maintaining material and having a first contacting portion and a second contacting portion, and a body retentively supporting the lead, the connector header configured to engage the power supply circuit board such that the first contacting portion of the lead is positioned within a pad of the power supply circuit board and the second contacting portion of the lead is positioned within one of:

a pad of the LED circuit board to electrically connect the power supply circuit board and the LED circuit board, wherein the second contacting portion of the lead is engaged in spring contact within the pad of the LED circuit board, and a pin cavity defined by the pin to electrically connect the power supply circuit board and the pin.

10. The LED-based light of claim 9, wherein the second contacting portion of the lead is axially inserted within the pin cavity.

11. The LED-based light of claim 9, wherein:

the first contacting portion projects from the body to extend beyond a surface of the body; and the engagement between the power supply circuit board and the connector header at least partially includes the first contacting portion positioned within the pad of the power supply circuit board and the surface of the body abutting the power supply circuit.

12. The LED-based light of claim 9, wherein the connector header includes a projection extending beyond a surface of the body; and the engagement between the power supply circuit board and the connector header at least partially includes the projection positioned within an aperture defined by the power supply circuit board and the surface of the body abutting the power supply circuit board.

13. The LED-based light of claim 9, further comprising:

a housing, wherein the LED circuit board, the power supply circuit board and the pin are spatially distributed with respect to one another within the housing.

14. A method of assembling components of an LED-based light configured for replacing a conventional fluorescent light in a fluorescent light fixture, the components including at least an LED circuit board including at least one LED, a power supply circuit board configured to supply power to the at least one LED and an end cap carrying at least one pin configured for connection to the fixture, comprising:

engaging the power supply circuit board with a connector header including at least one lead composed of a substantially shape maintaining material and having a first contacting portion and a second contacting portion, a body retentively supporting the lead, and a projection extending beyond a surface of the body, wherein the engagement positions the first portion within a pad of the power supply circuit board, axially aligns the second contacting portion with a pin cavity defined by the pin and inserts the second contacting portion within the pin cavity, slidably engages the second contacting portion into spring contact with a pad of the LED circuit board, and inserts the projection within an aperture defined by the power supply circuit board and abutting the surface of the body with the power supply circuit board; and electrically connecting the power supply circuit board to the one of the LED circuit board and the pin.

* * * * *